US009013097B2

(12) United States Patent
Takei

(10) Patent No.: US 9,013,097 B2
(45) Date of Patent: Apr. 21, 2015

(54) LIGHT-EMITTING MODULE, LIGHTING DEVICE, AND LIGHTING FIXTURE

(71) Applicant: Panasonic Corporation, Osaka (JP)

(72) Inventor: Naoko Takei, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 14/327,874

(22) Filed: Jul. 10, 2014

(65) Prior Publication Data

US 2015/0023011 A1 Jan. 22, 2015

(30) Foreign Application Priority Data

Jul. 19, 2013 (JP) ..... 2013-150583

(51) Int. Cl.
*H05B 33/02* (2006.01)
*F21K 99/00* (2010.01)

(52) U.S. Cl.
CPC ..... *F21K 9/56* (2013.01)

(58) Field of Classification Search
CPC ... H01L 33/50; H01L 33/502; H01L 25/0753; H01L 2924/0002
USPC ..... 313/498–503
See application file for complete search history.

(56) References Cited

U.S. PATENT DOCUMENTS

| | | | |
|---|---|---|---|
| 5,770,917 | A | 6/1998 | Yano et al. |
| 8,564,215 | B2 | 10/2013 | Okawa et al. |
| 2010/0207134 | A1 | 8/2010 | Tanaka et al. |
| 2012/0008318 | A1 | 1/2012 | Ishiwata et al. |

FOREIGN PATENT DOCUMENTS

| | | |
|---|---|---|
| JP | 3040719 | 5/2000 |
| JP | 2008-160061 | 7/2008 |
| JP | 2008-205133 | 9/2008 |
| JP | 2009-224074 | 10/2009 |
| JP | 2011-204659 | 10/2011 |
| JP | 2012-064888 | 3/2012 |

OTHER PUBLICATIONS

Color Science Association of Japan, "4.3 Color Rendering Property Evaluation Based on Feeling of Contrast", New Handbook for Color Science [3rd Edition], pp. 1-3.

*Primary Examiner* — Joseph L Williams
(74) *Attorney, Agent, or Firm* — Greenblum & Bernstein P.L.C.

(57) ABSTRACT

A light-emitting module including: a first light source including a first light-emitting element and a wavelength converter and emitting visible light having a chromaticity within rectangle range ABCD, the wavelength converter changing a wavelength of a portion of light emitted by the first light-emitting element; and a second light source including a second light-emitting element and emitting red light. The light-emitting module emits white light by mixing the visible light and the red light, and satisfies conditions $2.0 \leq (S_L - S_H)/(F_L - F_H) \leq 3.0$ and $0.01 \leq ((x_L - x_H)^2 + (y_L - y_H)^2)^{1/2} \leq 0.02$.

7 Claims, 17 Drawing Sheets

FIG. 8

Change in chromaticity according to rise in temperature
(Chromaticity at 25°C: Color temperature of 3000K; Duv of 0)

| | Relative output level of red light-emitting element at 55°C (Relative output level of blue light-emitting element: 90%) | Decrease rate ratio (red/blue) | Chromaticity at 55°C | Evaluation |
|---|---|---|---|---|
| Case 1 | 81% | 1.9 | Color temperature: 3250K, Duv: 3.4 | Color deviation: Small |
| Case 2 | 77% | 2.35 | Color temperature: 3400K, Duv: 5.5 | Color deviation: Large |
| Case 3 (Conventional) | 72% | 2.8 | Color temperature: 3530K, Duv: 8.0 | Color deviation: Large |

FIG. 10

Change in chromaticity according to rise in temperature

| | Chromaticity of illumination light at 25°C | Chromaticity of illumination light at 55°C | | |
|---|---|---|---|---|
| | | When the chromaticity of visible light is not shifted | When the chromaticity of visible light is shifted | |
| | | | Amount of shift | |
| Case 4 | Color temperature: 3000K, Duv: 0 | Color temperature: 3530K, Duv: 8 | 0.013 | Color temperature: 3300K, Duv: 2 |
| Case 5 | Color temperature: 3000K, Duv: 0 | Color temperature: 3530K, Duv: 8 | 0.018 | Color temperature: 3250K, Duv: 0 |
| Case 6 | Color temperature: 3000K, Duv: 0 | Color temperature: 3400K, Duv: 6 | 0.013 | Color temperature: 3200K, Duv: 0 |
| Case 7 | Color temperature: 5000K, Duv: 0 | Color temperature: 5700K, Duv: 10 | 0.02 | Color temperature: 5600K, Duv: 0 |

FIG. 13

Composition of materials contained in wavelength converter

| | When the chromaticity of visible light is not shifted | When the chromaticity of visible light is shifted |
|---|---|---|
| Case 4 | $(Sr,Ba)Si_2O_2N_2$:Eu (100%) | $(Sr,Ba)Si_2O_2N_2$:Eu (75%)<br>$Ba_2SiO_4$:Eu (25%) |
| Case 5 | $(Sr,Ba)Si_2O_2N_2$:Eu (100%) | $(Sr,Ba)Si_2O_2N_2$:Eu (60%)<br>$Ba_2SiO_4$:Eu (40%) |
| Case 6 | YAG (100%) | YAG (65%)<br>$(Ca,Sr)_3SiO_5$:Eu (35%) |
| Case 7 | $(Sr,Ba)Si_2O_2N_2$:Eu (100%) | $(Sr,Ba)Si_2O_2N_2$:Eu (65%)<br>$Ba_2SiO_4$:Eu (35%) |

LIGHT-EMITTING MODULE, LIGHTING DEVICE, AND LIGHTING FIXTURE

CROSS-REFERENCE TO RELATED APPLICATION

The disclosure of Japanese patent application No. 2013-150583 filed on Jul. 19, 2013, including the claims, specification, drawings and abstract thereof, is incorporated herein by reference in its entirety.

TECHNICAL FIELD

The present disclosure relates to a light-emitting module, a lighting device and a lighting fixture using a light-emitting element such as a light-emitting diode (LED). In particular, the present disclosure relates to technology of improving the illumination light of such a light-emitting module in terms of color deviation.

BACKGROUND ART

Conventionally, there have been practical white light sources which generate white light by converting a portion of blue light emitted by a blue LED to light having a wavelength corresponding to a color within the range of green to yellow by using a wavelength converter, and mixing the blue light with the light of the color within the range of green to yellow. Various kinds of light-emitting modules utilizing such a white light source have been commercialized.

However, a lighting fixture using such a white light source is likely to have poor color rendering properties. This is because the illumination light of the white light source does not contain a sufficient amount of red light component, which leads to poor color rendering properties.

Considering the above, there has been a proposal to improve the color rendering properties by combining the white light source with a red light source and supplementing the white light with the red light component of the red light source (Japanese Unexamined Patent Application Publication No. 2012-64888, and "Sinpen Shikisai Kagaku Handobukku", 3rd edition, edited by the Color Science Association of Japan).

However, the inventor actually manufactured a light-emitting module by combining a white light source with a red light source and lighted the light-emitting module, and found that a color deviation occurs in the illumination light under a particular lighting condition when a red LED is used as the red light source. That is, it was found that simply combining a white light source with a red LED is not enough to maintain a preferable chromaticity of the illumination light independently from the influence of lighting conditions.

The present invention is made in view of the above-described problem, and aims to provide a light-emitting module that is capable of maintaining a preferable chromaticity of the illumination light independently from the influence of lighting conditions.

SUMMARY OF THE INVENTION

To achieve the aim, a light-emitting module pertaining to one aspect of the present invention is a light-emitting module that emits white light generated by mixing red light and visible light of a color other than red, including: a first light source including a first light-emitting element and a wavelength converter and emitting the visible light, the wavelength converter changing a wavelength of a portion of light emitted by the first light-emitting element, the visible light having a chromaticity within rectangle range ABCD defined by coordinate points A(0.15,0.35), B(0.28,0.33), C(0.39,0.48) and D(0.25,0.55) on a CIE 1931 xy chromaticity diagram; a second light source including a second light-emitting element and emitting the red light, wherein $2.0 \leq (S_L - S_H)/(F_L - F_H) \leq 3.0$, where $S_L$, $S_H$, $F_L$, and $F_H$ are relative values to a predetermined reference value, and $S_L$ denotes an optical output level of the second light-emitting element measured when the second light-emitting element is at a first temperature, $S_H$ denotes the optical output level of the second light-emitting element measured when the second light-emitting element is at a second temperature that is higher than the first temperature by 30° C., $F_L$ denotes the optical output level of the first light-emitting element measured when the first light-emitting element is at the first temperature, and $F_H$ denotes the optical output level of the first light-emitting element measured when the first light-emitting element is at the second temperature, and $0.01 \leq ((x_L - x_H)^2 + (y_L - y_H)^2)^{1/2} \leq 0.02$, where chromaticity coordinates $(x_L, y_L)$ on the CIE 1931 xy chromaticity diagram identify the chromaticity of the visible light measured when the first light-emitting element is at the first temperature, and chromaticity coordinates $(x_H, y_H)$ on the CIE 1931 xy chromaticity diagram identify the chromaticity of the visible light measured when the first light-emitting element is at the second temperature.

It should be noted here that, in the present description, the terms used for identifying colors, such as white, red, blue and yellow are not intended to strictly adhere to the definition by the commission internationale de l'éclairage (CIE) (e.g. CIE defines that the wavelength of red light is 700 nm, the wavelength of blue light is 435.8 nm, and the wavelength of yellow light is 546.1 nm), but they only identify approximate wavelength ranges of light. For this reason, when it is necessary to specify a precise wavelength of light, the wavelength is specified by using a numerical range.

In the light-emitting module pertaining to one aspect of the present invention, when the wavelength converter is at the second temperature, an emission spectrum of the wavelength converter may have a maximum intensity at least 10% and no greater than 20% lower than when the wavelength converter is at the first temperature.

In the light-emitting module pertaining to one aspect of the present invention, the wavelength converter may contain at least a first phosphor and a second phosphor, and when the wavelength converter is at the second temperature, an emission spectrum of the first phosphor may have a maximum intensity no greater than 10% lower than when the wavelength converter is at the first temperature, and an emission spectrum of the second phosphor may have a maximum intensity at least 20% and no greater than 30% lower than when the wavelength converter is at the first temperature.

In the light-emitting module pertaining to one aspect of the present invention, the first phosphor may be a $Eu^{2+}$-activated oxynitride phosphor, and the second phosphor may be a $Eu^{2+}$-activated silicate phosphor.

In the light-emitting module pertaining to one aspect of the present invention, the first light-emitting element may emit blue light having a peak wavelength within a range of 450 nm to 470 nm, and the second light-emitting element may emit red light having a peak wavelength within a range of 610 nm to 650 nm.

A lighting device pertaining to one aspect of the present invention is a lighting device that emits white light generated by mixing red light and visible light of a color other than red, including: a first light source including a first light-emitting element and a wavelength converter and emitting the visible light, the wavelength converter changing a wavelength of a portion of light emitted by the first light-emitting element, the visible light having a chromaticity within rectangle range ABCD defined by coordinate points A(0.15,0.35), B(0.28, 0.33), C(0.39,0.48) and D(0.25,0.55) on a CIE 1931 xy chromaticity diagram; a second light source including a second light-emitting element and emitting the red light, wherein $2.0 \leq (S_L - S_H)/(F_L - F_H) \leq 3.0$, where $S_L$, $S_H$, $F_L$, and $F_H$ are relative values to a predetermined reference value, and $S_L$ denotes an optical output level of the second light-emitting element measured when the second light-emitting element is at a first temperature, $S_H$ denotes the optical output level of the second light-emitting element measured when the second light-emitting element is at a second temperature that is higher than the first temperature by 30° C., $F_L$ denotes the optical output level of the first light-emitting element measured when the first light-emitting element is at the first temperature, and $F_H$ denotes the optical output level of the first light-emitting element measured when the first light-emitting element is at the second temperature, and $0.01 \leq ((x_L - x_H)^2 + (y_L - y_H)^2)^{1/2} \leq 0.02$, where chromaticity coordinates $(x_L, y_L)$ on the CIE 1931 xy chromaticity diagram identify the chromaticity of the visible light measured when the first light-emitting element is at the first temperature, and chromaticity coordinates $(x_H, y_H)$ on the CIE 1931 xy chromaticity diagram identify the chromaticity of the visible light measured when the first light-emitting element is at the second temperature.

A lighting fixture pertaining to one aspect of the present invention is a lighting fixture that emits white light generated by mixing red light and visible light of a color other than red, including: a first light source including a first light-emitting element and a wavelength converter and emitting the visible light, the wavelength converter changing a wavelength of a portion of light emitted by the first light-emitting element, the visible light having a chromaticity within rectangle range ABCD defined by coordinate points A(0.15,0.35), B(0.28, 0.33), C(0.39,0.48) and D(0.25,0.55) on a CIE 1931 xy chromaticity diagram; a second light source including a second light-emitting element and emitting the red light, wherein $2.0 \leq (S_L - S_H)/(F_L - F_H) \leq 3.0$, where $S_L$, $S_H$, $F_L$, and $F_H$ are relative values to a predetermined reference value, and $S_L$ denotes an optical output level of the second light-emitting element measured when the second light-emitting element is at a first temperature, $S_H$ denotes the optical output level of the second light-emitting element measured when the second light-emitting element is at a second temperature that is higher than the first temperature by 30° C., $F_L$ denotes the optical output level of the first light-emitting element measured when the first light-emitting element is at the first temperature, and $F_H$ denotes the optical output level of the first light-emitting element measured when the first light-emitting element is at the second temperature, and $0.01 \leq ((x_L - x_H)^2 + (Y_L - y_H)^2)^{1/2} \leq 0.02$, where chromaticity coordinates $(x_L, y_L)$ on the CIE 1931 xy chromaticity diagram identify the chromaticity of the visible light measured when the first light-emitting element is at the first temperature, and chromaticity coordinates $(x_H, y_H)$ on the CIE 1931 xy chromaticity diagram identify the chromaticity of the visible light measured when the first light-emitting element is at the second temperature.

According to the light-emitting module pertaining to one aspect of the present invention, the first light source emits visible light having a chromaticity within rectangle range ABCD defined by connecting coordinate points A(0.15, 0.35), B(0.28,0.33), C(0.39,0.48) and D(0.25,0.55) on the CIE 1931 xy chromaticity diagram. Also, $2.0 \leq (S_L - S_H)/(F_L - F_H) \leq 3.0$ is satisfied. Furthermore, $0.01 \leq ((x_L - x_H)^2 + (y_L - y_H)^2)^{1/2} \leq 0.02$ is satisfied. Therefore, the amount of color deviation of the illumination light, which is caused by the difference between the decrease rate of the optical output level of the first light-emitting element and the decrease rate of the optical output level of the second light source, is small. Thus, the light-emitting module is suitable for maintaining a preferable chromaticity of the illumination light independently from lighting conditions.

Note that $F_L$ denotes the optical output level of the first light-emitting element measured when the first light-emitting element is at the first temperature, and $F_H$ denotes the optical output level of the first light-emitting element measured when the first light-emitting element is at the second temperature. Similarly, $S_L$ denotes the optical output level of the second light-emitting element measured when the second light-emitting element is at the first temperature, and $S_H$ denotes the optical output level of the second light-emitting element measured when the second light-emitting element is at the second temperature. The chromaticity coordinates $(x_L, y_L)$ on the CIE 1931 xy chromaticity diagram identify the chromaticity of the visible light measured when the first light-emitting element is at the first temperature, and the chromaticity coordinates $(x_H, y_H)$ on the CIE 1931 xy chromaticity diagram identify the chromaticity of the visible light measured when the first light-emitting element is at the second temperature.

BRIEF DESCRIPTION OF THE DRAWINGS

These and the other objects, advantages and features of the invention will become apparent from the following description thereof taken in conjunction with the accompanying drawings which illustrate a specific embodiment of the invention.

In the drawings:

FIG. 8 shows a relationship between a decrease rate ratio and color deviation;

FIG. 10 is a diagram showing a relationship between the amount of chromaticity shift applied to visible light, and a chromaticity of illumination light;

FIG. 13 shows a composition of phosphors contained in a wavelength converter;

DETAILED DESCRIPTION

The following describes a light-emitting module, lighting device and lighting fixture pertaining to one aspect of the present invention, with reference to the drawings.

<Lighting Fixture>

Figure 1:
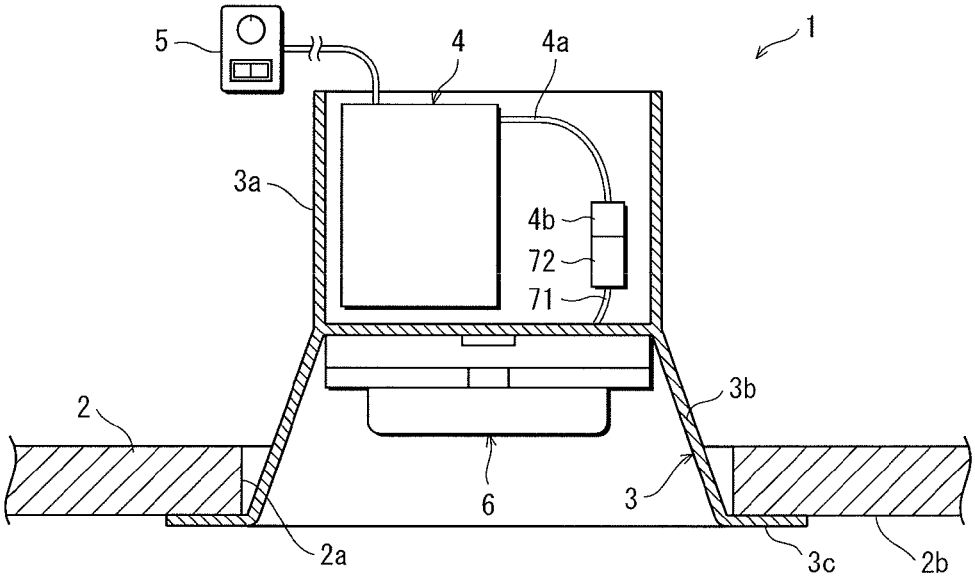
FIG. 1 is a cross-sectional view showing a lighting fixture pertaining to one aspect of the present invention.

FIG. 1 is a cross-sectional view showing a lighting fixture pertaining to one aspect of the present invention. As shown in FIG. 1, a lighting fixture 1 pertaining to one aspect of the present invention is, for example, a downlight installed by being embedded in a ceiling 2, and includes a fixture 3, a circuit unit 4, a dimming unit 5, and a lighting device 6.

The fixture 3 is made, for example, of metal, and includes a circuit housing 3*a*, a light source housing 3*b* and an outer flange 3*c*. The circuit housing 3*a* has, for example, a cylindrical shape with a bottom, and houses the circuit unit 4. The light source housing 3*b* has, for example, a cylindrical shape, and extends from the bottom edge of the circuit housing 3*a*. The light source housing 3*b* houses the lighting device 6. The outer flange 3*c* has, for example, an annular shape, and extends outward from the bottom edge of the light source housing 3*b* surrounding an opening provided in the light source housing 3*b*. The fixture 3 is fixed to the ceiling 2 by, for example, a screw (omitted from the drawing), with the circuit housing 3*a* and the light source housing 3*b* being embedded in an embedding hole 2*a* provided in the ceiling 2 and the outer flange 3*c* being in contact with the lower surface 2*b* of the part of the ceiling 2 that surrounds the embedding hole 2*a*.

The circuit unit 4 is a unit for receiving electric power from an external power source and lighting the lighting device 6. The circuit unit 4 has a power source line 4*a* electrically connected to the lighting device 6, and a connector 4*b* is provided at the tip of the power source line 4*a*. The connector 4*b* is detachably connected to a connector 72 of lead lines 71 of the lighting device 6. The power source may be either a direct-current (DC) power source or an alternate-current (AC) power source.

The dimming unit 5 is used by a user to control the brightness of the illumination light of the lighting device 6. The dimming unit 5 is electrically connected to the circuit unit 4, and outputs a dimming signal to the circuit unit 4 in response to a user operation.

<Lighting Device>

Figure 2:
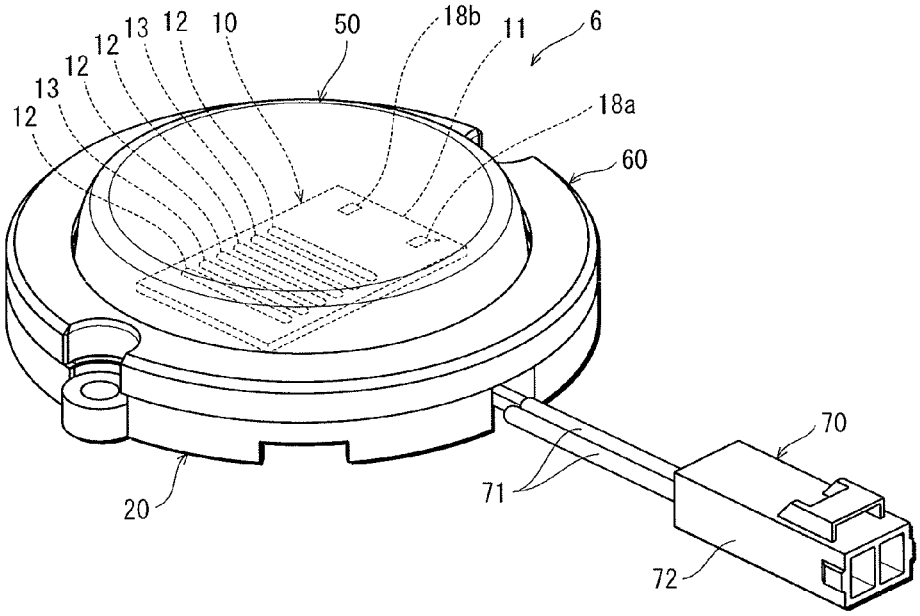
FIG. 2 is a perspective view showing a lighting device pertaining to one aspect of the present invention.

FIG. 2 is a perspective view showing a lighting device pertaining to one aspect of the present invention. As shown in FIG. 2, the lighting device 6 pertaining to one aspect of the present invention is a lamp unit having, for example, a disc-like appearance, and houses a light-emitting module 10.

Figure 3:
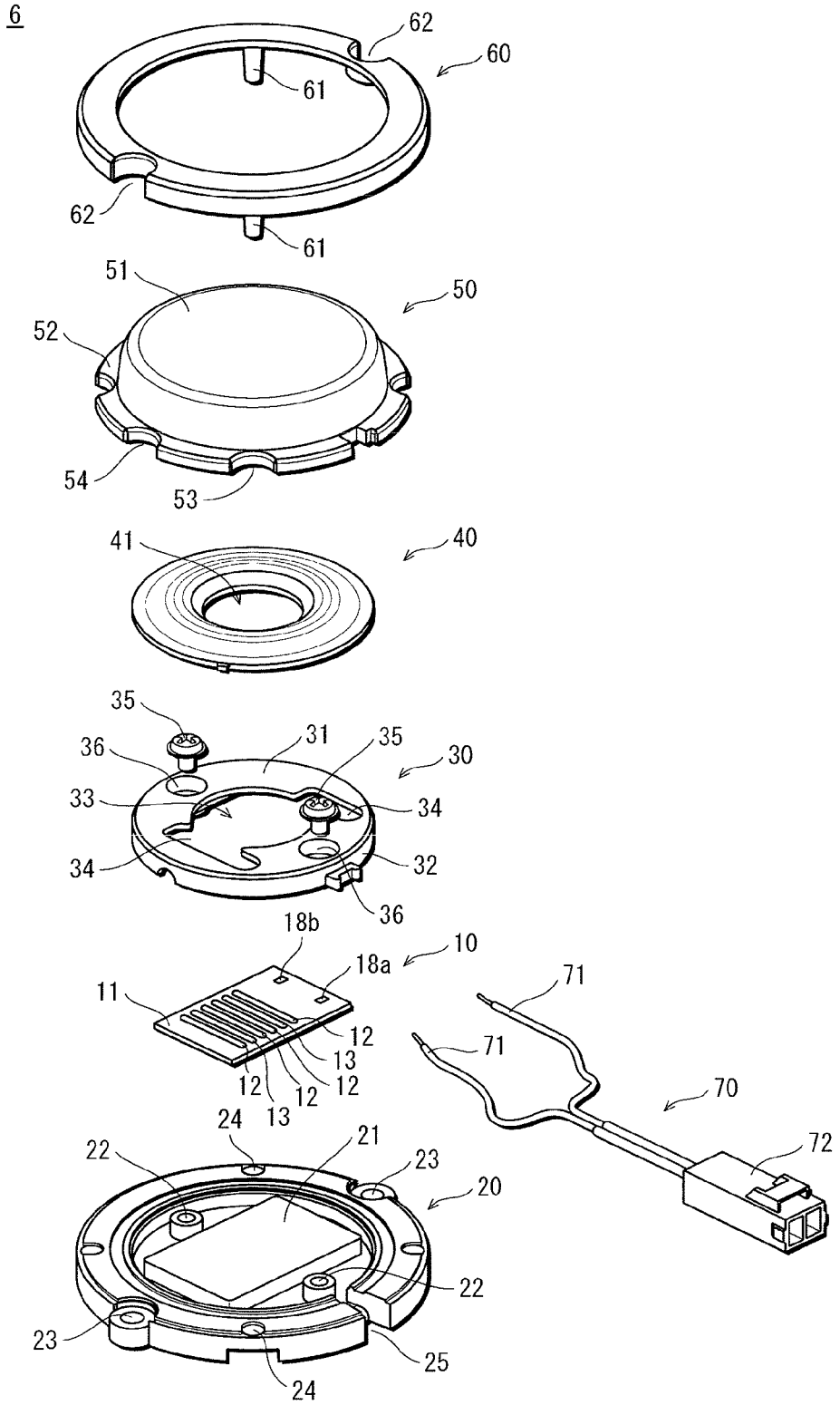
FIG. 3 is an exploded perspective view showing a lighting device pertaining to one aspect of the present invention.

FIG. 3 is an exploded perspective view showing a lighting device pertaining to one aspect of the present invention. As shown in FIG. 3, the lighting device 6 has a base 20, a holder 30, a decoration cover 40, a cover 50, a cover holder 60, a wiring part 70, and so on as well as the light-emitting module 10.

The light-emitting module 10 has first light sources 12 and second light sources 13. The light-emitting module 10 emits white light generated by mixing the light emitted by the first light sources 12 and the light emitted by the second light sources 13. The details of the light-emitting module 10 will be described later.

The base 20 is a disc-like aluminum die casting. The base 20 has a mounting part, which is provided in the central area of the upper surface of the base 20. The light-emitting module 10 is mounted on the mounting part 21. The base 20 also has screw holes 22, which are provided in the upper surface of the base 20. The mounting part 21 is located between the screw holes 22. The screw holes 22 engage with assembly screws 35 for fixing the holder 30. Furthermore, the base 20 has insertion holes 23, boss holes 24 and a cut 25, which are provided in the peripheral area of the base 20.

The holder 30 has, for example, a cylindrical shape with a bottom, and has a disc-like holder plate 31 and a cylindrical wall part 32 extending from the periphery of the holder plate 31 toward the base 20. The light-emitting module 10 is fixed to the base 20 by the holder plate 31 of the holder 30 pressing the substrate 11 of the light-emitting module 10 against the mounting part 21 of the base 20. The holder plate 31 has a window 33, which is provided in the central area of the holder plate 31, so that the light sources 12 and 13 of the light-emitting module 10 are exposed to the outside. The holder plate 31 also has an opening 34, which is provided in the peripheral area of the holder plate 31. The opening 34 communicates with the window 33 and prevents the lead lines 71 connected to the light-emitting module 10 from interfering with the holder 30. Furthermore, the holder plate 31 of the holder 30 has insertion holes 36, which are provided in the peripheral area of the holder plate 31. The insertion holes 36 correspond in position to the screw holes 22 of the base 20, and receive the assembly screws 35.

The decoration cover 40 is, for example, an annular member made of non-light transmissive material such as opaque white resin. The decoration cover 40 is located between the holder 30 and the cover 50, and covers up the lead lines 71 exposed from the opening 34, the assembly screws 35, and so on. The decoration cover 40 has a window 41, which is provided in the central area of the decoration cover 40, so that the light sources 12 and 13 are exposed to the outside.

The cover 50 is made, for example, of light-transmissive material such as silicone resin, acrylic resin, or glass. The light emitted by the light sources 12 and 13 pass through the cover 50 and travels outward from the lighting device 6. The cover 50 includes: a main body 51 that has a dome shape covering the light sources 12 and 13 and that serves as a lens; and an outer flange 52 extending outward from the edge of the main body 51. The outer flange 52 is fixed to the base 20. The outer flange 52 has cuts 53 each having a semicircular shape. The cuts 53 are respectively located in correspondence with bosses 61 of the cover holder 60 in order to make way for the bosses 61. The outer flange 52 also has cuts 54 each having a semicircular shape. The cuts 54 are respectively located in correspondence with insertion holes 23 of the base 20 in order to make way for screws (omitted from the drawing) to be inserted through the insertion holes 23.

The cover holder 60 is made, for example, of non-light transmissive material such as metal (e.g. aluminum) or opaque white resin. The cover holder 60 has an annular shape so as not to block the light from the main body 51 of the cover 50. The cover 50 is fixed to the base 20 by the cover holder 60 pressing the outer flange 52 of the cover 50 against the base 20. The cover holder 60 has bosses 61 each having a cylindrical column shape. The bosses 61 are located on the lower surface of the cover holder 60 and correspond in position to the boss holes 24 of the base 20. The cover holder 60 is fixed to the base 20 by inserting the bosses 61 of the cover holder 60 through the boss holes 24 of the base 20 and squeezing (or swaging) the heads of the bosses 61. The cover holder 60 also has cuts 62 each having a semicircular shape. The cuts 62 are respectively located in the peripheral area of the cover holder 60 in correspondence with insertion holes 23 of the base 20 in order to make way for screws (omitted from the drawing) to be inserted through the insertion holes 23.

The wiring part 70 has a pair of lead lines 71 electrically connected to the light-emitting module 10, and the connector 72 is connected to the ends of the lead lines 71 that are opposite the ends connected to the light-emitting module 10. The lead lines 71 of the wiring part 70 connected to the light-emitting module 10 are led out of the lighting device 6 via the cuts 25 of the base 20.

<Light-Emitting Module>

[Basic Configuration of Light-Emitting Module]

Figure 4A:
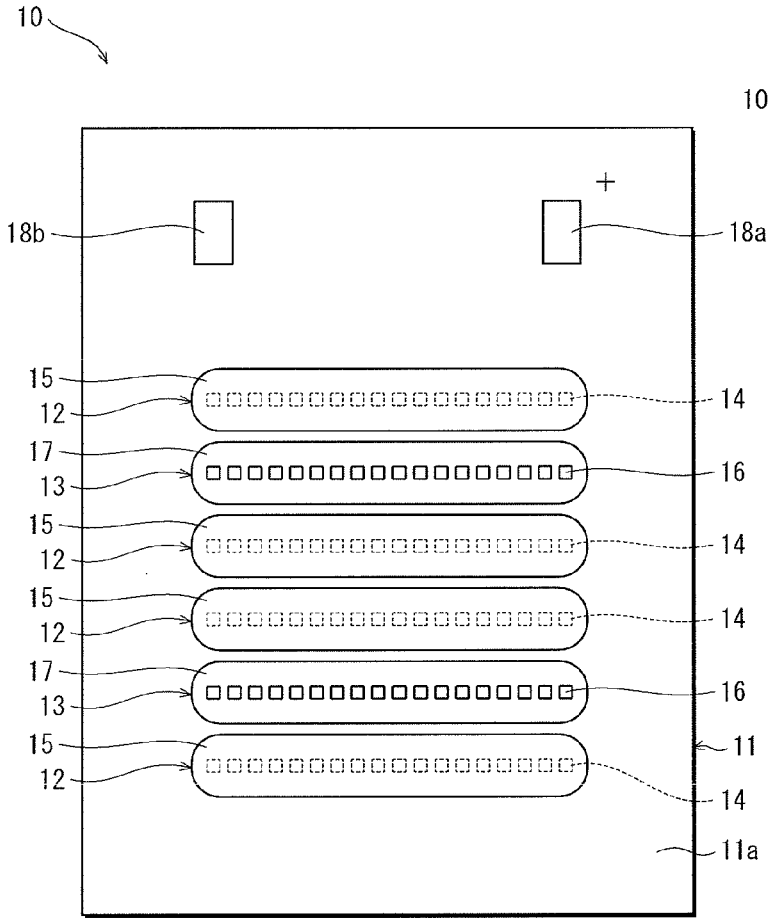
FIG. 4A is a plan view showing a light-emitting module pertaining to one aspect of the present invention.
Figure 4B:
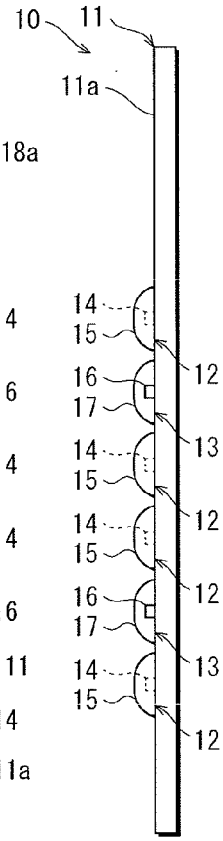
FIG. 4B is a right side view showing a light-emitting module pertaining to one aspect of the present invention.
Figure 4C:
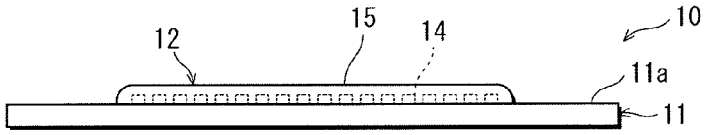
FIG. 4C is a frontal view showing a light-emitting module pertaining to one aspect of the present invention.

FIGS. 4A, 4B and 4C show a light-emitting module pertaining to one aspect of the present invention. FIG. 4A is a plan view, FIG. 4B is a right side view, and FIG. 4C is a frontal view. As shown in FIG. 4A through 4C, the substrate 11 has, for example, a rectangular plate-like shape, and has a two-layer structure composed of an insulative layer made from a ceramic plate, heat conductive resin, or the like, and a metal layer made from an aluminum plate or the like.

The first light sources 12 and the second light sources 13 are disposed on the upper surface 11*a* of the substrate 11. Each of the first light sources 12 and the second light sources 13 has an elongated shape (see FIG. 4A). The cross-sections of the light sources along a virtual plane intersecting at right angles with the longitudinal direction of the light sources are each substantially semi-elliptical (See FIG. 4B). The ends of each light source in the longitudinal direction have a rounded shape. Specifically, each end has, for example, the shape of a quarter of a sphere (See FIG. 4C). A plurality of first light sources 12 and a plurality of second light sources 13 are disposed in parallel at equal intervals, and both the left ends and the right ends are aligned.

Each first light source 12 has a plurality of first light-emitting elements 14 and a wavelength converter 15 that changes the wavelength of a portion of light emitted by the first light-emitting elements 14. In each first light source 12, eighteen first light-emitting elements 14 are arranged in a straight line at equal intervals, for example. All the eighteen first light-emitting elements 14 are sealed with a single wavelength converter 15 having an elongated shape.

Each first light-emitting element 14 is, for example, a blue LED that emits blue light having a peak wavelength within the range of 450 nm to 470 nm. The first light-emitting elements 14 are mounted on the upper surface 11*a* of the substrate 11 by chip-on-board (COB) technology so as to face upward. The wavelength converter 15 is made, for example, of a light-transmissive material containing phosphors, and converts the wavelength of the blue light emitted by the first light-emitting elements 14 to a wavelength corresponding to a color within the range of green to yellow. Each first light source 12 emits visible light generated by mixing a portion of the blue light emitted by the first light-emitting elements 14, which is not converted, with the light of the color within the range from green to yellow, which has been generated by the conversion by the wavelength converter 15.

The first light-emitting elements 14 pertaining to the present embodiment are not limited to blue LEDs that emit blue light having a peak wavelength within the range of 450 nm to 470 nm. The first light-emitting elements 14 may be blue LEDs that emit blue light having a different wavelength, or LEDs that emit ultraviolet light. Furthermore, the first light-emitting elements 14 pertaining to the present embodiment are not necessarily LEDs. The first light-emitting elements 14 may be laser diodes (LDs), electroluminescence (EL) elements, or the likes.

Each second light source 13 has a plurality of second light-emitting elements 16 and a sealer 17 that seals the second light-emitting elements 16. In each second light source 13, eighteen second light-emitting elements 16 are arranged in a straight line at equal intervals, for example. All the eighteen second light-emitting elements 16 are sealed with the single sealer 17 having an elongated shape.

Each second light-emitting element 16 is a red LED that emits red light having a peak wavelength within the range of 615 nm to 660 nm. The second light-emitting elements 16 are mounted on the upper surface 11*a* of the substrate 11 by COB technology so as to face upward. The sealer 17 is made, for example, of light-transmissive material that is colorless and transparent. Since the wavelength of the red light emitted by the second light-emitting elements 16 is not converted by the sealer 17, each second light source 13 emits red light.

The second light-emitting elements 16 pertaining to the present embodiment are not limited to red LEDs that emit red light having a peak wavelength within the range of 615 nm to 660 nm. The second light-emitting elements 16 may be red LEDs that emit red light having a different wavelength. Furthermore, the second light-emitting elements 16 pertaining to the present embodiment are not necessarily LEDs. The second light-emitting elements 16 may be LDs, EL elements, or the likes.

The light-emitting module 10, which has light sources of two colors, namely the first light sources 12 and the second light sources 13, emits white light generated by mixing the visible light emitted by the first light sources 12 and the red light emitted by the second light sources 13. In the present embodiment, the color temperature of the white light emitted by the light-emitting module 10 is at least 2500 K and no greater than 6000 K. Such white light is suitable for illumination.

Figure 5:
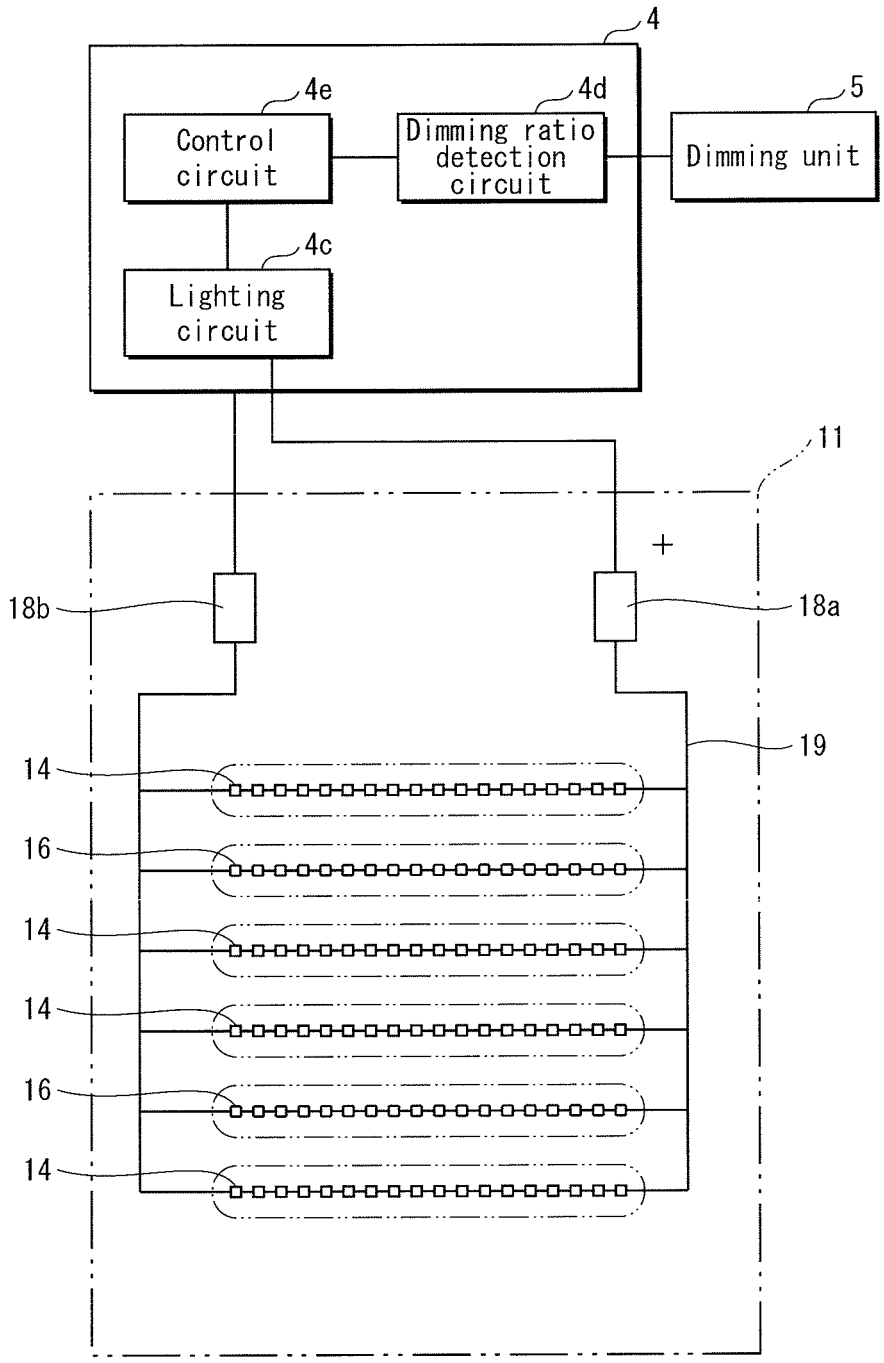
FIG. 5 is a wiring diagram showing connections between a light-emitting module and a circuit unit pertaining to one aspect of the present invention.

FIG. 5 is a wiring diagram showing connections between a light-emitting module and a circuit unit pertaining to one aspect of the present invention. As shown in FIG. 5, the substrate 11 is provided with a conductor pattern having terminals 18*a* and 18*b* and a wiring line 19. The terminals 18*a* and 18*b* are formed in the peripheral area of the upper surface 11*a* of the substrate 11. The wiring line 19 electrically connects the light-emitting elements 14 and 16 with the terminals 18*a* and 18*b*. There are six rows of light-emitting elements, and each row contains eighteen light-emitting elements of the same type (14 or 16) connected in series. The six rows are connected in parallel. Thus a series-parallel connection is formed.

The circuit unit 4 includes a lighting circuit 4*c*, a dimming ratio detection circuit 4*d*, and a control circuit 4*e*. The circuit unit 4 is electrically connected to an external commercial AC power supply (omitted from the drawing), and supplies electric current from the commercial AC power source to the light-emitting module 10. The lighting circuit 4*c* includes an AC/DC converter, and converts AC voltage from the commercial AC power source to DC voltage, and applies the DC voltage to each of the light sources 12 and 13 according to an instruction from the control circuit 4*e*. The dimming ratio detection circuit 4*d* acquires a dimming signal containing dimming ratio information from the dimming unit 5. The control circuit 4*e* performs PWM control on each of the light sources 12 and 13 based on the dimming ratio.

[Detailed Configuration of Light-Emitting Module]

The color deviation of the illumination light is caused by the lack of the red color component of the illumination light resulting from the decrease in optical output level of the red light emitted by the second light-emitting elements 16 when the temperature of the second light-emitting elements 16 rises. The inventor ascertained this fact by the experiments and observations explained below. Furthermore, the inventor solved the problem of the color deviation by employing a configuration that shifts the chromaticity of the visible light emitted by the first light sources 12 to be closer to the chromaticity of blue light according to the rise in temperature of the first light sources 12.

(1) First, the following provides an explanation of the decrease in optical output level of the red light emitted by the second light-emitting elements 16 according to the rise in temperature of the second light-emitting elements 16.

Figure 6:
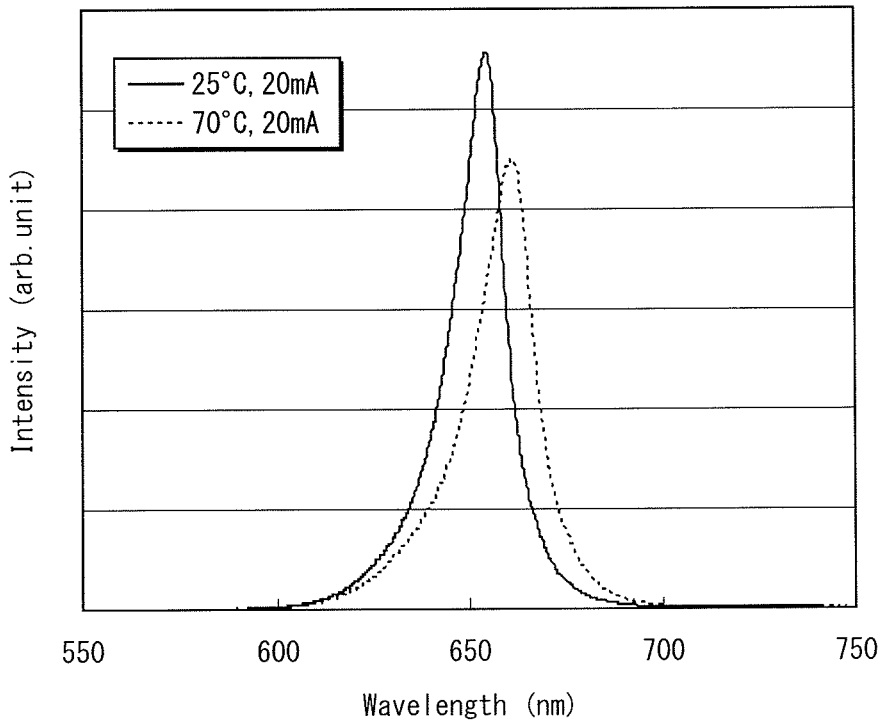
FIG. 6 is a graph showing a relationship between the temperature and the optical output level of a red LED.

FIG. 6 is a graph showing the relationship between the temperature and the optical output level of a red LED. The X axis shown in FIG. 6 represents the wavelength of the red light emitted by a red LED. The Y axis represents the optical output level of the red light emitted by the red LED. Note that the temperature of the red LED is represented by the temperature of the rear side of the substrate, which is measured specifically at the point that is opposite the red LED mounted on the front side of the substrate. As shown in FIG. 6, when the amount of current applied to the red LED is constant, the optical output level of the red LED decreases with the increased temperature of the red LED.

According to the light-emitting module 10 pertaining to the present embodiment, each of the second light-emitting elements 16 is a red LED that reduces its optical output level according to the temperature rise. Since the temperature of the second light-emitting elements 16 rises when the temperature of the second light sources 13 rises, the optical output level of the second light-emitting elements 16 decreases when the temperature of the second light sources 13 rises. When the optical output level of the second light-emitting elements 16 decreases, the optical output level of the red light emitted by the second light sources 13 decreases. When the optical output level of the red light emitted by the second light sources 13 decreases relatively to the optical output level of the visible light emitted by the first light sources 12, the color deviation occurs in the illumination light due to the lack of the red color component. That is, the color deviation occurs in the illumination light when the ratio of the decrease in optical output level of the second light-emitting elements 16 relative to the decrease in optical output level of the first light-emitting elements 14 increases. This ratio is hereinafter referred to as "decrease rate ratio". The decrease rate ratio indicates the degree of the lack of the red light relative to the blue light, and a larger decrease rate ratio indicates a higher degree of the lack of the red color component from the illumination light.

(2) Next, an explanation is provided on the degree of the decrease rate ratio that could cause the color deviation of the illumination light.

Figure 7:
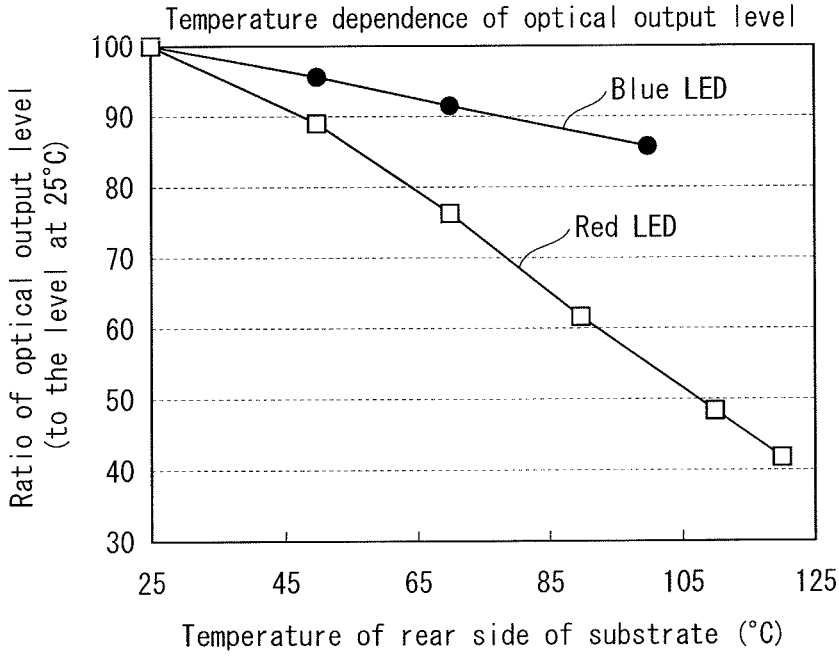
FIG. 7 is a graph showing a relationship between the temperature and the optical output level of blue and red LEDs.

FIG. 7 is a graph showing the relationship between the temperature and the optical output level with respect to each of blue and red LEDs. As shown in FIG. 7, when the optical output level of the blue light emitted by the blue LED is assumed to be 100% under the condition that the temperature of the blue LED is 25° C., the optical output level of the blue light emitted by the blue LED is approximately 95% under the condition that the temperature of the blue LED is 55° C. That is, the decrease rate of the optical output level of the blue LED is approximately 5% when the temperature of the blue LED rises from 25° C. to 55° C. Note that the temperature of the blue LED is measured at the rear side of the substrate, specifically at the point that is opposite the blue LED mounted on the front side of the substrate (as denoted by "Temperature of rear side of substrate" in FIG. 7).

On the other hand, when the optical output level of the red light emitted by the red LED is assumed to be 100% under the condition that the temperature of the red LED is 25° C., the optical output level of the red light emitted by the red LED is approximately 86% under the condition that the temperature of the red LED is 55° C. That is, the decrease rate of the optical output level of the red LED is approximately 14% when the temperature of the red LED rises from 25° to 55°. Note that the temperature of the red LED is measured at the rear side of the substrate, specifically at the point that is opposite the red LED mounted on the front side of the substrate (as denoted by "Temperature of rear side of substrate" in FIG. 7).

Therefore, the decrease rate (approximately 14%) of the optical output level of the red LED in the case where the temperature of the red LED rises from 25° to 55° is approximately 2.8 times the decrease rate (approximately 5%) of the optical output level of the blue LED in the case where the temperature of the blue LED rises from 25° C. to 55° C. In other words, the decrease rate ratio in the case where the temperature of each LED rises from 25° C. to 55° C. is approximately 2.8. As described above, the optical output level of a red LED is more likely than a blue LED to decrease according to the rise in temperature.

As apparent from the results shown in FIG. 7, it is not only when the temperatures of the LEDs rise from 25° C. to 55° C. that the LEDs show such tendency. This is for the following reasons. The decrease rate of the optical output level of blue LEDs is substantially constant insofar as the temperature of the blue LEDs is within the range of 25° C. to 100° C. Also, the decrease rate of the optical output level of red LEDs is substantially constant insofar as the temperature of the red LEDs is within the range of 25° C. to 120° C. That is, the decrease rate ratio is constant at approximately 2.8 insofar as the temperature of the LEDs is within the range of 25° C. to 100° C. For example, the decrease rate ratio remains constant when the temperature rises from 25° C. to 55° C. by 30° C., when the temperature rises to 65° C. by 40° C., when the temperature rises to 75° C. by 50° C., and so on. This means that each of the blue LEDs and the red LEDs show a substantially constant decrease rate of the optical output level insofar as their temperatures are within the range in which the light-emitting module 10 can light normally. In the following, it is assumed that the first temperature is 25° C. and the second temperature is 55° C. However, the red LEDs show a substantially constant decrease rate of the optical output level insofar as their temperatures are within the range in which the light-emitting module 10 can light normally. Therefore, the conclusion in the case where the first temperature is 25° C. and the second temperature is 55° C. is applicable to the entire range in which the light-emitting module 10 can light normally.

Each first light-emitting element 14 and each second light-emitting element 16 pertaining to the present embodiment are respectively a blue LED and a red LED whose decrease ratio is at least 2.0 and no greater than 3.0 when their temperatures rise from the first temperature to the second temperature. In the following description, $F_L$ denotes the optical output level of the first light-emitting element 14 measured when the temperature of the first light-emitting element 14 is at the first temperature. $F_H$ denotes the optical output level of the first light-emitting element 14 measured when the temperature of the first light-emitting element 14 is at the second temperature. $S_L$ denotes the optical output level of the second light-emitting element 16 measured when the temperature of the second light-emitting element 16 is at the first temperature. $S_H$ denotes the optical output level of the second light-emitting element 16 measured when the temperature of the second light-emitting element 16 is at the second temperature. Note that $S_L$, $S_H$, $F_L$ and $F_H$ are relative values to a predetermined reference value. The decrease rate ratio measured when the temperatures of the first light-emitting element 14 and the second light-emitting element 16 rise from the first temperature to the second temperature can be represented by $(S_L-S_H)/((F_L-F_H)$. The first light-emitting element 14 and the second light-emitting element 16 pertaining to the present embodiment satisfy $2.0 \leq (S_L-S_H)/(F_L-F_H) \leq 3.0$.

FIG. 8 shows the relationship between the decrease rate ratio and the color deviation. The inventor manufactured light-emitting modules corresponding to Cases 1 through 3 with different decrease rate ratios, and evaluated the color deviation of each module. As shown in FIG. 8, the inventor found that the color deviation is small when the decrease rate ratio is less than 2.0, but the color deviation is large when the decrease rate ratio is 2.0 or greater. In particular, when the decrease rate ratio is 2.3 or greater, the color deviation is noticeable. In this way, when the decrease rate ratio is less than 2.0, the decrease rate of the first light-emitting element 14 and the decrease rate of the second light-emitting element 16 are too small and there is no significant difference between the optical output level of the blue light and the optical output level of the red light. Accordingly, the color deviation is small. Therefore, there is little need for employing the first light sources 12 that shift the chromaticity of the visible light to be closer to the chromaticity of blue light according to the temperature rise.

When the decrease rate ratio is 2.0 or greater, the color deviation of the illumination light is noticeable due to the lack of the red light component relative to the blue light component. When the decrease rate ratio is 2.0 or greater but not greater than 3.0, it is possible to effectively reduce the color deviation of the illumination light by employing the first light sources 12 that shift the chromaticity of the visible light to be closer to the chromaticity of blue light. This is the reason why the light-emitting module 10 pertaining to the present embodiment employs the first light-emitting elements 14 and the second light-emitting elements 16 that satisfy $2.0 \leq (S_L-S_H)/(F_L-F_H) \leq 3.0$.

When the decrease rate ratio is greater than 3.0, the difference between the decrease rate of the optical output level of the first light-emitting elements 14 and the decrease rate of the optical output level of the second light-emitting elements 16 is too large, and it is difficult to effectively reduce the color deviation of the illumination light even if the first light sources 12 that shift the chromaticity of the visible light to be closer to the chromaticity of blue light are employed.

As described above, it was found that the color deviation of the illumination light is caused by the lack of red light component resulting from the temperature rise. It was also found that the color deviation of the illumination light of conventional light-emitting modules, occurring due to the temperature rise of the first light-emitting elements and the second light-emitting elements, is caused because conventional light-emitting modules have been designed without consideration of the lack of red light component resulting from the temperature rise. In contrast, in the light-emitting module 10 pertaining to the present embodiment, the color deviation of the illumination light is reduced by shifting the chromaticity of the visible light emitted by the first light sources 12 to be closer to the chromaticity of blue light according to the decrease in optical output level of the red light emitted by the second light sources 13 resulting from the temperature rise.

(3) Next, an explanation is provided on the visible light emitted by the first light sources 12.

Figure 9:
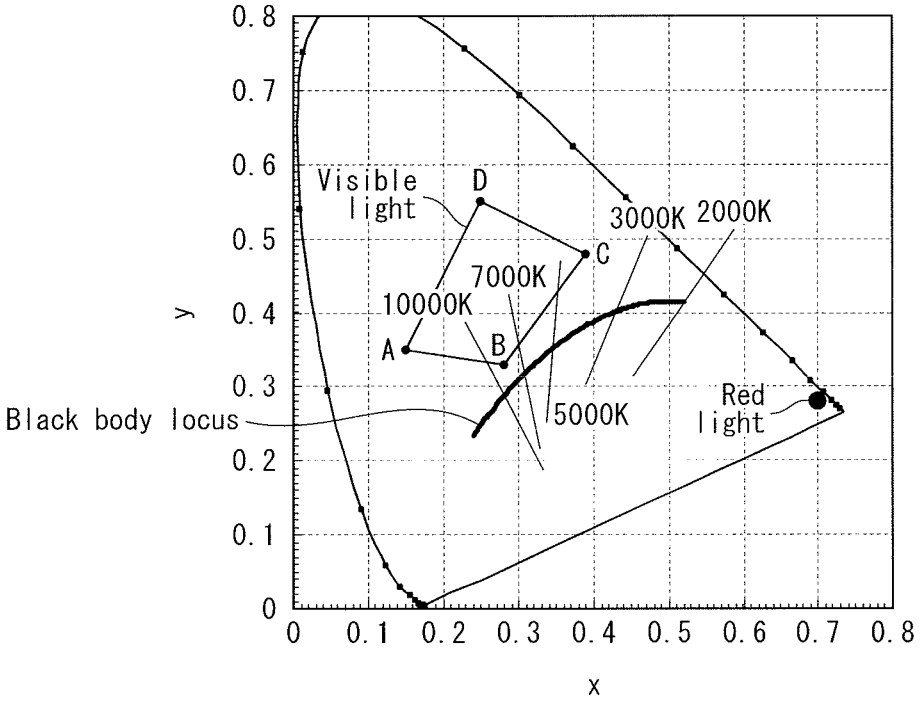
FIG. 9 is a xy chromaticity diagram illustrating the chromaticity of a first light source and a second light source.

FIG. 9 is a xy chromaticity diagram illustrating the chromaticity of the light emitted by the first light sources and the light emitted by the second light sources. The visible light emitted by the first light sources 12 has a chromaticity within rectangle range ABCD defined by connecting the coordinate points A(0.15,0.35), B(0.28,0.33), C(0.39,0.48) and D(0.25, 0.55) on the CIE 1931 xy chromaticity diagram shown in FIG. 9. When the chromaticity of the visible light emitted by the first light sources 12 is within rectangle range ABCD, the illumination light exhibits preferable color rendering properties in combination with the red light emitted by the second light sources 13. However, the color deviation of the illumination light occurs according to the temperature rise of the second light-emitting elements 16. Considering this, the light-emitting module 10 pertaining to the present embodiment employs the first light sources 12 that shift the chromaticity of the visible light to be closer to the chromaticity of blue light according to the temperature rise, thereby reducing the color deviation of the illumination light resulting from the temperature rise. With this structure, the light-emitting module 10 maintains a preferable chromaticity of the illumination light without being affected by lighting conditions.

When the chromaticity of the visible light emitted by the first light sources 12 is closer to the black body locus than to rectangle range ABCD, the color deviation of the illumination light is unlikely to occur, because the optical output level of the red light to be combined with the visible light is originally low. Therefore, there is little need for employing the first light sources 12 that shift the chromaticity of the visible light to be closer to the chromaticity of blue light according to the temperature rise. When the chromaticity of the visible light emitted by the first light sources 12 is farther from the black body locus than from rectangle range ABCD, the color deviation of the illumination light is likely to be too large, because the optical output level of the red light to be combined with the visible light is high. Therefore, even if the light-emitting module 10 employs the first light sources 12 that shift the chromaticity of the visible light to be closer to the chromaticity of blue light according to the temperature rise, it is difficult to satisfactorily reduce the color deviation.

(4) Next, an explanation is provided on how much to shift the chromaticity of the visible light emitted by the first light sources 12 to be closer to the chromaticity of blue light according to the temperature rise.

Assume that the chromaticity of the visible light emitted by the first light sources 12 is represented by chromaticity coordinates $(x_L,y_L)$ on the CIE 1931 xy chromaticity diagram when the temperature of the first light-emitting elements 14 is at the first temperature. Similarly, assume that the chromaticity of the visible light emitted by the first light sources 12 is represented by chromaticity coordinates $(x_H,y_H)$ on the chromaticity diagram when the temperature of the first light-emitting elements 14 is at the second temperature. On these assumptions, the amount of the shift applied to the visible light emitted by the first light sources 12 according to the temperature rise can be represented by $((x_L-x_H)^2+(y_L-y_H)^2)^{1/2}$. The light-emitting module 10 pertaining to the present embodiment satisfies $0.01 \leq ((x_L-x_H)^2+(y_L-y_H)^2)^{1/}$ $_2 \leq 0.02$. That is, the amount of the chromaticity shift applied to the visible light is at least 0.01 and no greater than 0.02.

FIG. 10 is a diagram showing the relationship between the amount of the chromaticity shift applied to the visible light and the chromaticity of the illumination light. For each of Cases 4 through 7, the inventor manufactured a light-emitting module that does not shift the chromaticity of the visible light and a light-emitting module that shifts the chromaticity of the visible light, and measured the chromaticity of the illumination light emitted by each light-emitting module. Some of Cases 4 through 7 exhibit different color temperatures, and some exhibit a same color temperature but different spectra at the same color temperature. As a result of the measurement, the inventor found that, when the amount of the shift is at least 0.01 and not greater than 0.02, the light-emitting modules that shift the chromaticity of the visible light noticeably reduce the color deviation compared with the light-emitting modules that do not shift the chromaticity of the visible light. On the other hand, when the amount of the shift is less than 0.01, it is difficult to satisfactorily reduce the color deviation, because the amount of the shift is too small. Similarly, when the amount of the shift is greater than 0.02, it is difficult to satisfactorily reduce the color deviation, because the amount of the shift is too large.

Figure 11:
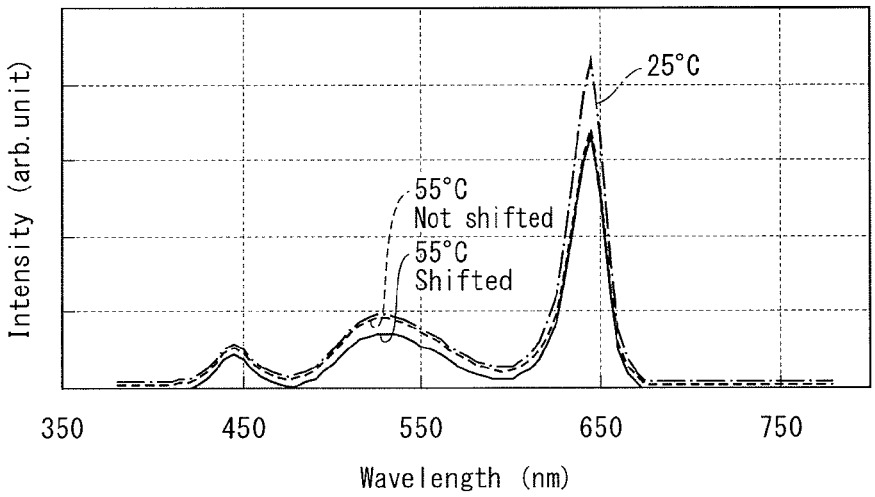
FIG. 11 is a diagram showing an optical spectrum of illumination light.
Figure 12:
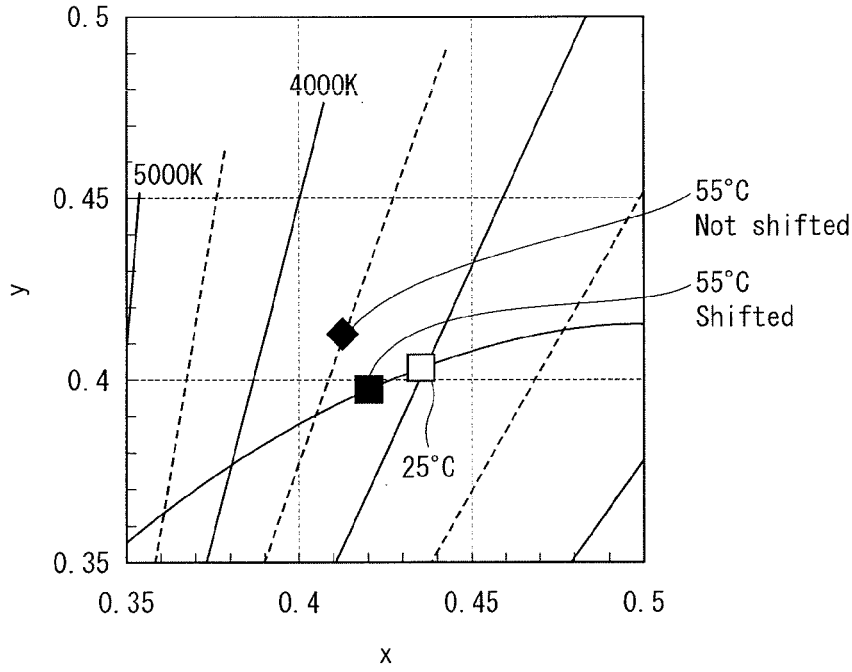
FIG. 12 is a diagram for illustrating change in chromaticity according to rise in temperature.

FIG. 11 is a diagram showing an optical spectrum of illumination light. FIG. 12 is a diagram illustrating the change in chromaticity according to the temperature rice. In the case of not shifting the chromaticity of the visible light, when the temperature of each of the light-emitting elements 14 and 16 rises from the first temperature to the second temperature, the optical output level of the red light decreases, but the optical output level of the yellow-green light does not decrease, as shown in FIG. 11. Accordingly, the chromaticity of the illumination light deviates greatly from the black body locus, as shown in FIG. 12.

On the other hand, when the chromaticity of the visible light is shifted such that the amount of the shift will be 0.01 or greater but no greater than 0.02, the optical output level of the yellow-green light decreases as well as the optical output level of the red light when the temperature of each of the light-emitting elements 14 and 16 rises by 30° C., as shown in FIG. 11. That is, when the temperature of the first light-emitting elements 14 rises and the temperature of the wavelength converter 15 rises accordingly, the maximum intensity of the emission spectrum of the wavelength converter 15 decreases, and the visible light emitted by the first light sources 12 lacks the color component having a wavelength corresponding to a color within the range of green to yellow. The chromaticity of the visible light is thus shifted to be closer to the chromaticity of blue light. Consequently, as shown in FIG. 11, the optical output level of the yellow-green light decreases. Therefore, as shown in FIG. 12, although the chromaticity of the illumination light is shifted slightly, it is still located on the black body locus, and the color deviation is not noticeable.

(5) Next, the following describes the structure of the wavelength converter 15 for realizing the first light sources 12 that shift the chromaticity of the visible light by at least 0.01 and no greater than 0.02.

The first light sources 12 that shift the chromaticity of the visible light by at least 0.01 and no greater than 0.02 can be realized by modifying the composition of the phosphors contained in the wavelength converter 15. Specifically, such first light sources 12 can be realized by modifying the composition of the phosphors contained in the wavelength converter 15 such that the maximum intensity of the emission spectrum of the wavelength converter 15 decreases by at least 10% and no greater than 20% when the temperature of the wavelength converter 15 rises by 30° C., for example.

The wavelength converter 15, whose emission spectrum shows a decrease in maximum intensity of at least 10% and no greater than 20% when the temperature of the wavelength converter 15 increases by 30° C., can be realized by changing the combination of the phosphors to be contained in the wavelength converter 15. For example, one option is to combine a phosphor (hereinafter "the first phosphor") whose emission spectrum shows a decrease in the maximum intensity of no greater than 10% when the temperature of the wavelength converter 15 rises by 30° C., and a phosphor (hereinafter "the second phosphor") whose emission spectrum shows a decrease in the maximum intensity of at least 20% and no greater than 30% when the temperature of the wavelength converter 15 rises by the same degree.

FIG. 13 shows the composition of the phosphors contained in the wavelength converter. To realize the first light sources 12 that shift the chromaticity of the visible light by at least 0.01 and no greater than 0.02, the composition of the phosphors contained in the wavelength converter 15 may be set according to, for example, "When the chromaticity of the visible light is shifted" corresponding to each of Cases 4 through 7 shown in FIG. 13. On the other hand, when the composition of the phosphors is set according to "When the chromaticity of the visible light is not shifted" corresponding to each of Cases 4 through 7 shown in FIG. 13, it is impossible to shift the chromaticity of the visible light by 0.01 or greater. In FIG. 13, each of $(Sr,Ba)Si_2O_2N_2$:Eu and YAG is the first phosphor, and each of $Ba_2SiO_4$:Eu and $(Ca,Sr)_3SiO_5$:Eu is the second phosphor.

It is not necessary that only one of the first phosphors and only one of the second phosphors are combined. For example, in order to realize preferable temperature dependence, it is possible to use a plurality of types of first phosphor and/or a plurality of types of second phosphor. For example, as for the first phosphor and/or the second phosphor, a phosphor having a large temperature dependence and a phosphor having a small temperature dependence may be combined. For example, it is possible to obtain illumination light with excellent color rendering properties by combining a $Eu^{2+}$-activated oxynitride phosphor as an example of the first phosphor with a $Eu^{2+}$-activated silicate phosphor as an example of the second phosphor. To increase the amount of the shift in order to reduce the color deviation, the proportion of the phosphor having a large temperature dependence should be increased. Since the relationship between the amount of the shift and the proportion of the phosphor is different depending on the emission color of the phosphor, it is necessary to change the proportion according to the emission color of the phosphor.

Here, "a phosphor having a large temperature dependence" means a phosphor whose external quantum efficiency decreases by at least 20% and no greater than 25% when the temperature of the phosphor increases by 30° C. Examples of the phosphor having a large temperature dependence include silicate-containing phosphor, a sulfide phosphor, and so on. Specifically, the silicate-containing phosphor is $(Ba,Sr)_2SiO_4$:$Eu^{2+}$,$Ba_2SiO_4$:Eu, or $(Ca,Sr)_3SiO_5$:Eu for example, and the sulfide phosphor is $SrGa_2S_4$:Eu, for example.

Note that light emitted by a $EU^{2+}$-activated alkaline earth metal silicate phosphor and a sulfide phosphor has a narrow spectrum half width. Therefore, in order to obtain illumination light with excellent color rendering properties, it is preferable to combine such phosphors with another phosphor that emits light having a wide spectrum half width, rather than using them alone.

Similarly, "a phosphor having a small temperature dependence" means a phosphor whose external quantum efficiency decreases by less than 5% when the temperature of the phosphor increases by 30° C. Examples of the phosphor having a small temperature dependence include a $Eu^{2+}$-activated oxynitride phosphor, a sialon-based oxynitride phosphor, a sulfide phosphor, a $Ce^{3+}$-activated garnet-based oxide phosphor, and so on. Specifically, examples of such a phosphor include $Ca(Si,Al)_{12}(O,N)_{16}:Eu^{2+}$, $BaSi_6O_{12}N_2Eu^{2+}$, $Y_3Al_5O_{12}:Ce^{3+}$, and so on.

In conventional light-emitting modules, the wavelength converter 15, which converts the wavelength of the blue light emitted by the first light-emitting elements 14, does not contain both a phosphor having a large temperature dependence and a phosphor having a small temperature dependence. This is because it has been considered preferable to use a phosphor having a small temperature dependence in order to improve the light emission efficiency of the first light sources 12, and it has not be considered beneficial to combine a phosphor having a large temperature dependence with a phosphor having a small temperature dependence.

Note that it is possible to realize the wavelength converter 15 whose emission spectrum shows a decrease in the maximum intensity of at least 10% and no greater than 20% when the temperature of the wavelength converter 15 increases by 30° C. by using one of the phosphors alone, instead of combining the different kinds of phosphors as described above. Furthermore, when combining the different kinds of phosphors, the phosphors may be mixed, or arranged in layers without being mixed.

<Modifications>

The following describes modifications of the light-emitting module, lighting device, and lighting fixture pertaining to aspects of the present invention.

[Modifications of Light-Emitting Module]

(Modification 1)

The light-emitting module pertaining to one aspect of the present invention is not limited to the light-emitting module 10 pertaining to the above-described embodiment.

Figure 14A:
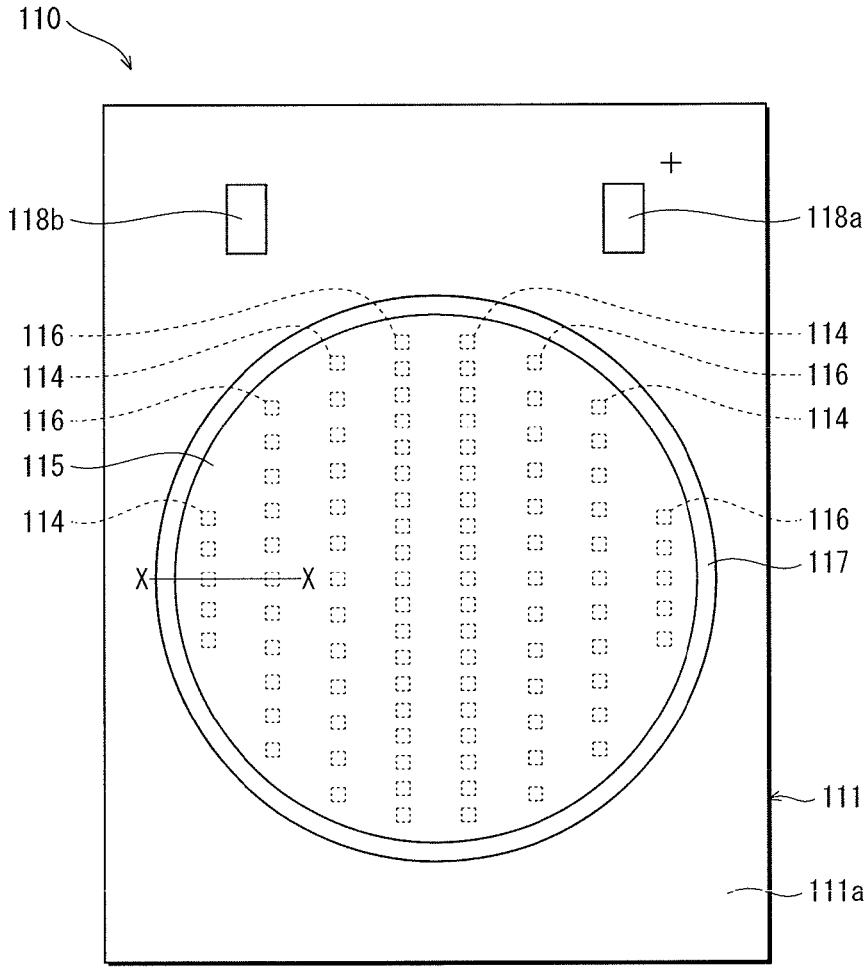
FIG. 14A is a plan view showing a light-emitting module pertaining to Modification 1.
Figure 14B:
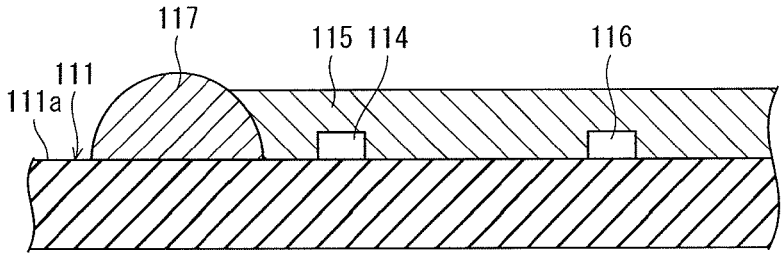
FIG. 14B is a cross-sectional view along the X-X line shown in FIG. 14A.

FIGS. 14A and 14B show a light-emitting module pertaining to Modification 1. FIG. 14A is a plan view, and FIG. 14B is a cross-sectional view along the line X-X shown in FIG. 14A. As shown in FIGS. 14A and 14B, a light-emitting module 110 pertaining to Modification 1 includes a substrate 111, a plurality of first light-emitting elements 114, a wavelength converter 115, a plurality of second light-emitting elements 116, a frame 117, and a pair of terminals 118*a* and 118*b*.

The substrate 111 has a substantially rectangular plate-like shape for example, and has a two-layer structure composed of an insulative layer made from a ceramic plate, heat conductive resin, or the like, and a metal layer made from an aluminum plate or the like. On the upper surface 111*a* of the substrate 111, the plurality of first light-emitting elements 114 and the plurality of second light-emitting elements 116 are disposed by COB technology so as to face upward.

Each first light-emitting element 114 is, for example, a blue LED that is the same as the first light-emitting element 14 pertaining to the above-described embodiment. The first light-emitting elements 114 are grouped such that each first light-emitting element 114 belongs to any one of four straight rows arranged in parallel. Each second light-emitting element 116 is, for example, a red LED that is the same as the second light-emitting element 16 pertaining to the above-described embodiment. The second light-emitting elements 116 are also grouped such that each second light-emitting element 116 belongs to any one of four straight rows arranged in parallel. The eight rows, namely the four rows of the first light-emitting elements 114 and the four rows of the second light-emitting elements 116, are arranged alternately so that a row of light-emitting elements of one type is not adjacent with a row of light-emitting elements of the other type. This arrangement reduces unevenness in color. Furthermore, the eight rows, composed of the rows of the first light-emitting elements 114 and the rows of the second light-emitting elements 116, are arranged such that a row that is more distant from the center point of the wavelength converter 115 in the direction perpendicular to the longitudinal direction of the rows has a shorter length. The envelope curve, which is formed by the edges of the eight rows (i.e. sixteen edges in total), is substantially circular.

The wavelength converter 115 has a substantially circular shape in plan view, and made of light-transmissive material containing a phosphor. All the first light-emitting elements 114 and the second light-emitting elements 116 are sealed with the wavelength converter 115 alone. The phosphors contained in the wavelength converter 115 are, for example, the same as the phosphors contained in the wavelength converter 15 pertaining to the above-described embodiment. Also, the light-transmissive material contained in the wavelength converter 115 is, for example, the same as the light-transmissive material contained in the wavelength converter 15 pertaining to the above-described embodiment.

The first light-emitting elements 114 emit blue light, the second light-emitting elements 116 emit red light, and the wavelength converter 115 converts the wavelength of a portion of the blue light to a wavelength corresponding to a color within the range of green to yellow. Therefore, the light-emitting module 110 emits white light generated by mixing the blue light, the red light and the light of the color within the range of green to yellow. In the present modification, each first light source is composed of the first light-emitting elements 114 and the wavelength converter 115. Each second light source is composed of the second light-emitting elements 116.

According to the present modification, the visible light emitted by the first light sources has a chromaticity within rectangle range ABCD on the CIE 1931 xy chromaticity diagram shown in FIG. 9. The decrease rate ratio is at least 2.0 and no greater than 3.0. The amount of the shift applied to the chromaticity of the visible light emitted by the first light sources is at least 0.01 and no greater than 0.02. Therefore, the chromaticity of the visible light emitted by the first light sources is shifted to be closer to the chromaticity of blue light according to the decrease in optical output level of the red light emitted by the second light sources resulting from the temperature rise. Thus, the stated structure reduces the color deviation of the illumination light caused by the decrease in optical output level of the red light resulting from the temperature rise.

The frame 117 has a substantially annular shape, and is disposed on the upper surface 111*a* of the substrate 111 so that the frame 117 surrounds the wavelength converter 115. The wavelength converter 115 defines the shape of the wavelength converter 115 before being fixed. Note that the frame 117 is not essential for the light-emitting module pertaining to one aspect of the present invention. The light-emitting module may have a structure without the frame 117.

The terminals 118*a* and 118*b* are formed with a conductor pattern disposed in a peripheral area of the upper surface 111*a* of the substrate 111. The terminals 118*a* and 118*b* supply electric power to the first light-emitting elements 114 and the second light-emitting elements 116, and each terminal is connected to the lighting circuit 4*c* of the circuit unit 4 via the lead line 71 shown in FIG. 1.

(Modification 2)

Figure 15A:
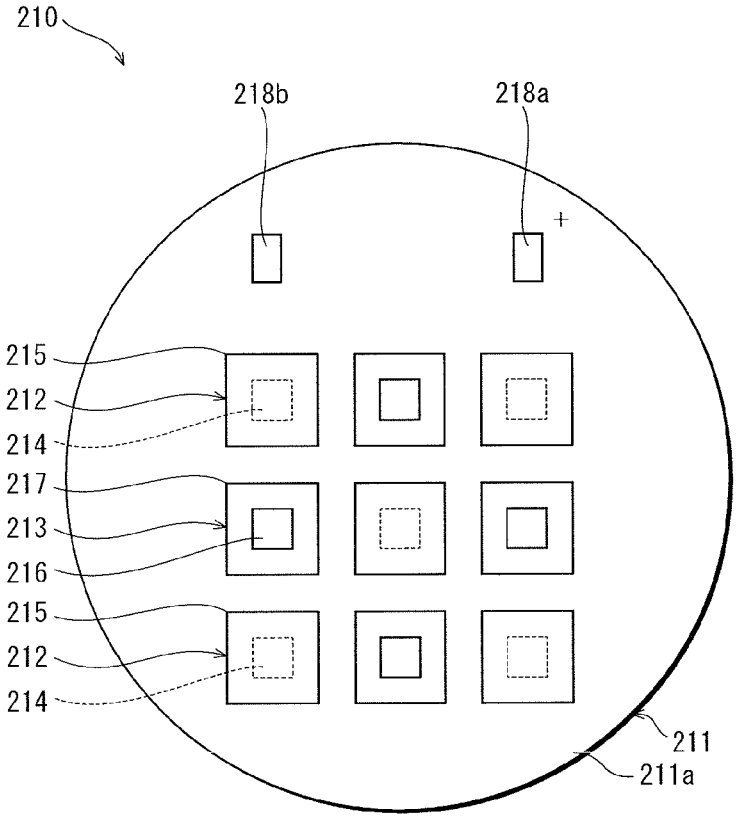
FIG. 15A is a plan view showing a light-emitting module pertaining to Modification 2.
Figure 15B:
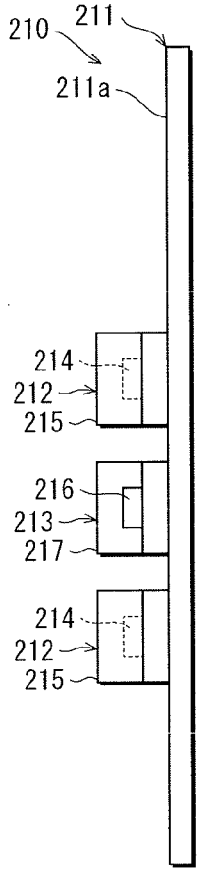
FIG. 15B is a right side view showing a light-emitting module pertaining to Modification 2.
Figure 15C:
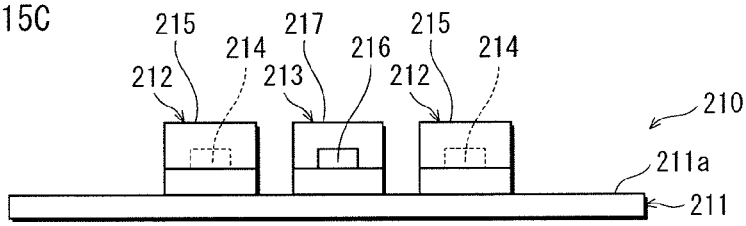
FIG. 15C is a frontal view showing a light-emitting module pertaining to Modification 2.

FIGS. 15A through 15C show a light-emitting module pertaining to Modification 2. FIG. 15A is a plan view, FIG. 15B is a right side view, and FIG. 15C is a frontal view. As shown in FIG. 15A through 15C, a light-emitting module 210 pertaining to Modification 2 includes a substrate 211 having a substantially circular plate-like shape and first light sources 212 and second light sources 213 mounted on the upper surface 211*a* of the substrate 211. The first light sources 212 and the second light sources 213 are of the surface mount device (SMD) type.

The first light sources 212 emit visible light having a chromaticity within rectangle range ABCD defined by connecting the coordinate points A(0.15,0.35), B(0.28,0.33), C(0.39, 0.48) and D(0.25,0.55) on the CIE 1931 xy chromaticity diagram shown in FIG. 9. The second light sources emit red light. The visible light and the red light are mixed, and thus white light is generated.

Each first light source 212 has a first light-emitting element 214 that emits blue light and a wavelength converter 215 that converts the wavelength of a portion of the blue light to the wavelength of light of a color within the range of green to yellow. Each second light source 213 has a second light-emitting element 216 that emits red light, and a sealer 217 that is colorless and transparent and that seals the second light-emitting element 216.

The first light sources 212 and the second light sources 213 are arranged to form a matrix pattern with gaps therebetween, and each light source has a substantially square shape in plan view of the upper surface 211*a* of the substrate 211. Since the first light sources 212 and the second light sources 213 are arranged alternately such that adjacent light sources have different colors, the light emitted by each first light source 212 and the light emitted by each second light source 213 are likely to be mixed uniformly, and are unlikely to cause unevenness in color.

According to the present modification, the visible light emitted by the first light sources 212 has a chromaticity within rectangle range ABCD on the CIE 1931 xy chromaticity diagram shown in FIG. 9. The decrease rate ratio is at least 2.0 and no greater than 3.0. The amount of the shift applied to the chromaticity of the visible light emitted by the first light sources 212 is at least 0.01 and no greater than 0.02. Therefore, the chromaticity of the visible light emitted by the first light sources 212 is shifted to be closer to the chromaticity of blue light according to the decrease in optical output level of the red light emitted by the second light sources 213 resulting from the temperature rise. Thus, the stated structure reduces the color deviation of the illumination light caused by the decrease in optical output level of the red light resulting from the temperature rise.

(Others)

According to another modification of the light-emitting module, the number of the first light sources and the number of the second light sources are not limited to any particular numbers. It suffices if there is at least one first light source and at least one second light source. Furthermore, the number of the light-emitting elements included in each first light source or each second light source is not limited to any particular number. Furthermore, the light-emitting module may include an additional light source other than the first light sources and the second light sources.

In addition, although each of the first light sources and second light sources of the light-emitting module 10 pertaining to the above-described embodiment has an elongated straight shape, the shape of the first light sources and second light sources pertaining to one aspect of the present invention may be determined freely. For example, each light source does not necessarily have the shape of a straight line, and may have the shape of a curved line. Furthermore, each light source may have a polygonal or circular shape. It is also acceptable that each light source has a shape formed by combining the shape of a straight line, a curved line, a polygonal shape, a circular shape, and so on. In addition, the arrangement of the first light sources and the second light sources is not limited to any particular pattern.

[Modification of Lighting Device]

The lighting device pertaining to one aspect of the present invention is not limited to the lighting device 6 pertaining to the above-described embodiment.

For example, although the lighting device pertaining to the above-described embodiment is applied to a lamp unit for a downlight, this is not essential for the lighting device pertaining to one aspect of the present invention. For example, the lighting device may be applied to a straight-tube LED lamp and an LED bulb described below that are expected as alternatives to straight-tube fluorescent lamps. Note that the straight-tube LED lamp mentioned above refers to an LED lamp that has substantially the same shape as a conventional general straight-tube fluorescent lamp using electrode coils. The LED bulb mentioned above refers to an LED lamp that has substantially the same shape as a conventional incandescent lamp.

(Modification 3)

Figure 16:
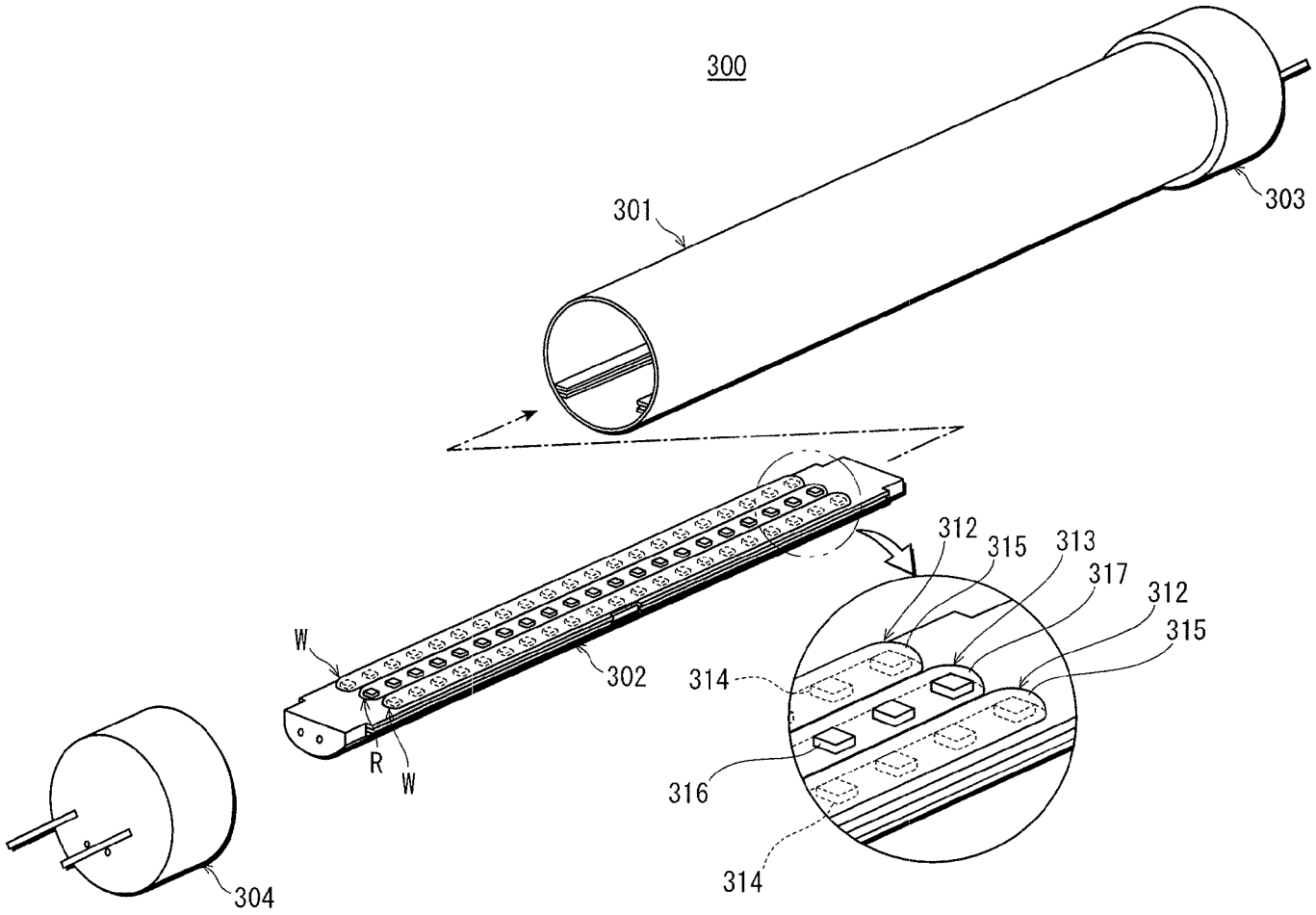
FIG. 16 is an exploded perspective view showing a lighting device pertaining to Modification 3.

FIG. 16 is an exploded perspective view showing a lighting device pertaining to Modification 3. As shown in FIG. 16, a lighting device 300 pertaining to Modification 3 includes a housing 301 having an elongated cylindrical shape, a mount 302 disposed within the housing 301, first light sources 312 and a second light source 313 disposed on the mount 302, and a pair of bases 303 and 304 attached to both ends of the housing 301.

The housing 301 has an elongated cylindrical shape with openings provided at both ends. The first light sources 312, the second light source 313, and the mount 302 are housed within the housing 301. Although the material of the housing 301 is not particularly limited, a light-transmissive material is preferable. Examples of the light-transmissive material include resin such as plastic, glass, or the like. The cross-sectional shape of the housing 301 is not particularly limited, and may be circular or polygonal.

The mount 302 has an elongated plate-like shape, and the ends thereof respectively extend to areas near the pair of bases 303 and 304. The mount 302 has the same length as the housing 301 in the longitudinal direction. It is preferable that the mount 302 serves as a heat sink for dissipating heat generated by the first light sources 312 and the second light source 313. For this purpose, it is preferable that the mount 302 is made of a material having a high thermal conductivity such as metal.

The pair of bases 303 and 304 are each attached to a socket of a lighting fixture (omitted from the drawing). Under the condition that the lighting device 300 is attached to the lighting fixture, electric power is applied to the first light sources 312 and the second light source 313 via the pair of bases 303 and 304. Heat generated by the first light sources 312 and the second light source 313 is conducted to the lighting fixture via the mount 302 and the pair of bases 303 and 304.

Each first light source 312 includes a plurality of first light-emitting elements 314 and a wavelength converter 315. The first light-emitting elements 314 are arranged in a straight row along the longitudinal direction of the mount 302, and each first light-emitting element 314 emits blue light. The wavelength converter 315 has an elongated shape and seals the first light-emitting elements 314, and converts the wavelength of a portion of the blue light to a wavelength corresponding to a color within the range of green to yellow.

Each second light source 313 includes a plurality of second light-emitting elements 316 and a sealer 317. The second light-emitting elements 316 are arranged in a straight row along the longitudinal direction of the mount 302, and each second light-emitting element 316 emits red light. The sealer 317 is colorless and transparent, and seals the second light-emitting elements 316.

The first light sources 312 and the second light source 313 respectively perform the same functions as the first light sources 12 and the second light sources 13 pertaining to the above-described embodiment. There are two first light sources 312 and one second light source 313, which are arranged in parallel on the mount 302 at intervals. Each light source has an elongated shape extending along the longitudinal direction of the mount 302.

According to the present modification, the visible light emitted by the first light sources 312 has a chromaticity within rectangle range ABCD on the CIE 1931 xy chromaticity diagram shown in FIG. 9. The decrease rate ratio is at least 2.0 and no greater than 3.0. The amount of the shift applied to the chromaticity of the visible light emitted by the first light sources 312 is at least 0.01 and no greater than 0.02. Therefore, the chromaticity of the visible light emitted by the first light sources 312 is shifted to be closer to the chromaticity of blue light according to the decrease in optical output level of the red light emitted by the second light source 313 resulting from the temperature rise. Thus, the stated structure reduces the color deviation of the illumination light caused by the decrease in optical output level of the red light resulting from the temperature rise.

(Modification 4)

Figure 17:
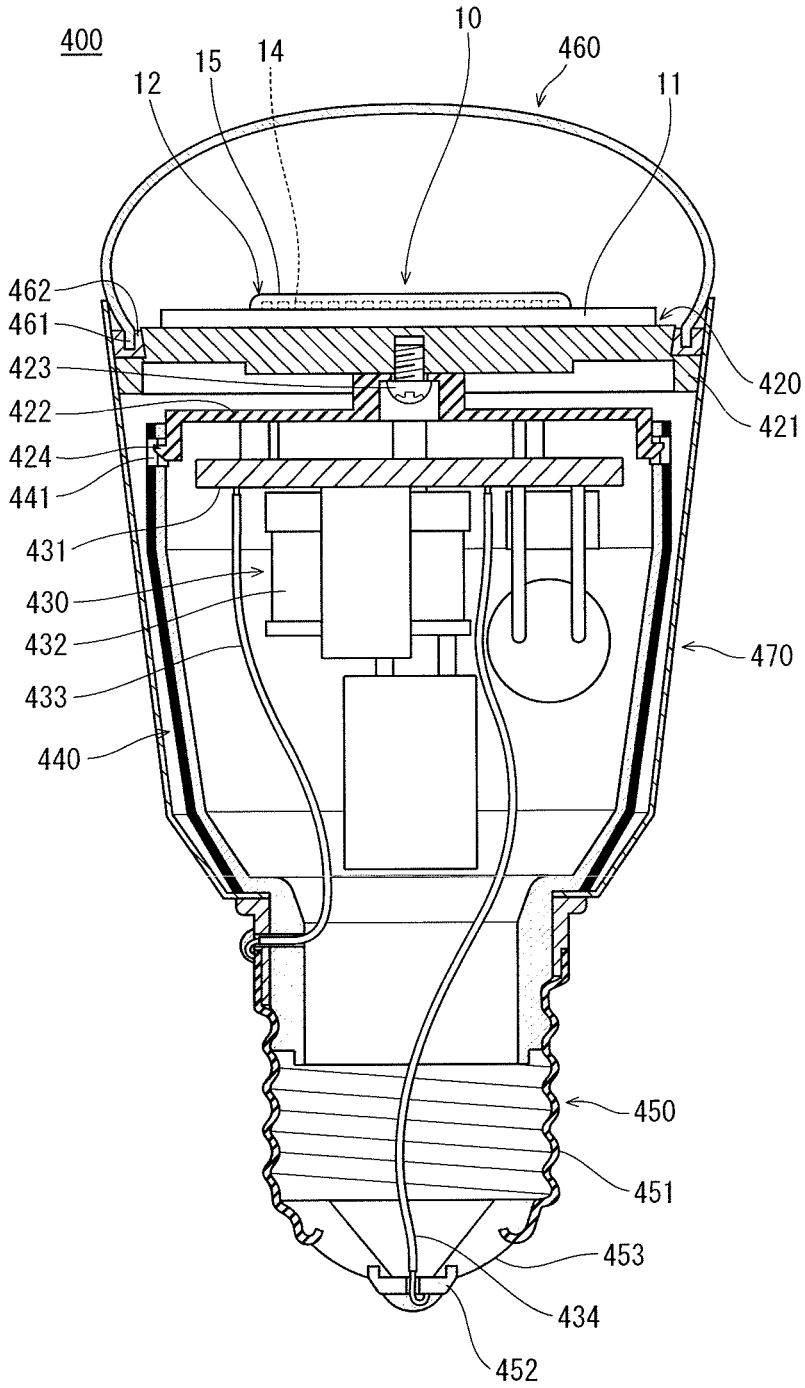
FIG. 17 is a cross-sectional view showing a lighting device pertaining to Modification 4.

FIG. 17 is a cross-sectional view showing a lighting device pertaining to Modification 4. As shown in FIG. 17, a lighting device 400 pertaining to Modification 4 is an LED bulb including mainly a light-emitting module 10, a holder 420, a circuit unit 430, a circuit case 440, a base 450, a globe 460, and a housing 470.

The light-emitting module 10 is the same as the light-emitting module 10 pertaining to the above-described embodiment, and includes, as shown in FIG. 4, the substrate 11, the first light sources 12, the second light sources 13, the terminals 18*a* and 18*b*, and the wiring line 19. Each first light source 12 is composed of the first light-emitting elements 14 and the wavelength converter 15, and each second light source 13 is composed of the second light-emitting elements 16 and the sealer 17. Therefore, the chromaticity of the visible light emitted by the first light sources 13 is shifted to be closer to the chromaticity of blue light according to the decrease in optical output level of the red light emitted by the second light sources 13 resulting from the temperature rise. Thus, the stated structure reduces the color deviation of the illumination light ranged by the decrease in optical output level of the red light resulting from the temperature rise.

The holder 420 includes a module holding part 421 and a circuit holding part 422. The module holding part 421 is a substantially disc-like part for attaching the light-emitting module 10 to the housing 470. The module holding part 421 is made of material having a high thermal conductivity such as aluminum. Therefore, owing to its material properties, the module holding part 421 serves as a heat conductor for conducting heat generated by the light-emitting module 10 to the housing 470. The circuit holding part 422 is a substantially disc-like part that is made, for example, of synthetic resin. The circuit holding part 422 is fixed to the module holding part 421 by a screw 423. The circuit holding part 422 has an engaging claw 424, which is provided at the periphery thereof and engages with the circuit case 440.

The circuit unit 430 includes a circuit board 431 and a plurality of electronic components 432 mounted on the circuit board 431. The circuit unit 430 is housed within the housing 440, with the circuit board 431 thereof being fixed to the circuit holding part 422. The circuit unit 430 is electrically connected to the light-emitting module 10. The circuit unit 430 is equivalent to the circuit unit 4 of the above-described embodiment, in which the lighting circuit 4*c*, the dimming ratio detection circuit 4*d* and the control circuit 4*e* are unitized.

The circuit case 440 is attached to the circuit holding part 422, with the circuit unit 430 being housed therein. The circuit case 440 has an engaging hole 441 for engagement with the engaging claw 424 of the circuit holding part 422. The circuit case 440 is fixed to the circuit holding part 422 by engagement of the engaging claw 424 with the engaging hole 441.

The base 450 is of a type defined by Japanese Industrial Standard (JIS), such as of the E-type, and is used as an attachment to a socket (omitted from the drawing) of a common incandescent lamp. The base 450 includes a shell 451, which is also referred to as a cylindrical barrel, and an eyelet 452 having a disc-like shape. The base 450 is attached to the circuit case 440. The shell 451 and the eyelet 452 are integrated in one piece, with an insulating part 453 made of glass being interposed therebetween. The shell 451 and the eyelet 452 are electrically connected to a power feed line 433 and a power feed line 434 of the circuit unit 430, respectively.

The globe 460 is substantially dome-shaped, and the edge 461 of the opening thereof is fixed to the housing 470 and the module holding part 421 by adhesive 462 such that the globe 460 covers the light-emitting module 10.

The housing 470 is, for example, cylindrical. The light-emitting module 10 is located closer to one of the openings of the housing 470, and the base 750 is located closer to the other one of the openings of the housing 470. The base material of the housing 470 is material having a high thermal conductivity such as aluminum, so that the housing 470 serves as a heat sink for dissipating heat generated by the light-emitting module 10.

(Modification 5)

Figure 18:
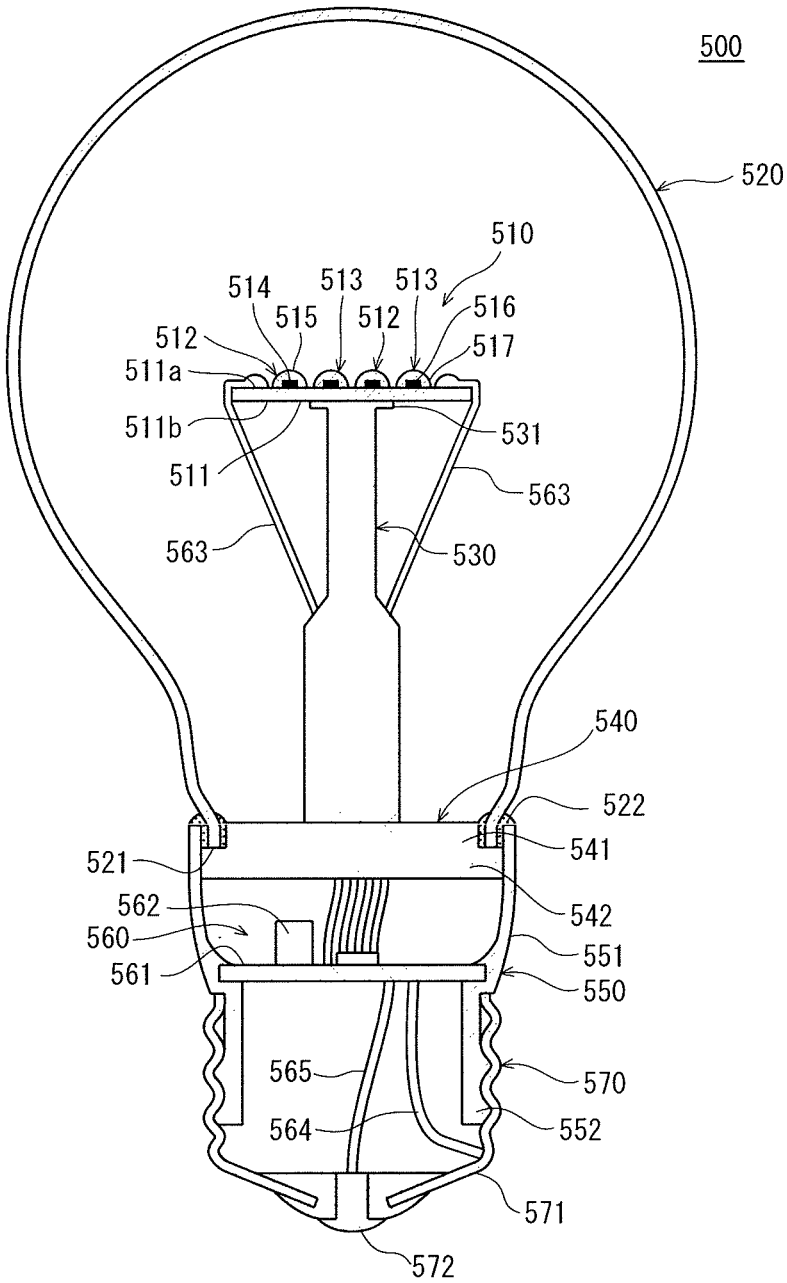
FIG. 18 is a cross-sectional view showing a lighting device pertaining to Modification 5.

FIG. 18 is a cross-sectional view showing a lighting device pertaining to Modification 5. As shown in FIG. 18, a lighting device 500 pertaining to Modification 5 is an LED bulb including mainly a light-emitting module 510, a globe 520, a stem 530, a supporting member 540, a case 550, a circuit unit 560, and a base 570.

The light-emitting module 510 includes a substrate 511, first light sources 512, and second light sources 513. The substrate 511 is a light-transmissive substrate made of light-transmissive material, and the first light sources 512 and the second light sources 513 are mounted on the upper surface 511*a* of the substrate 511.

Each first light source 512 includes a plurality of first light-emitting elements 514 and a wavelength converter 515. The first light-emitting elements 514 are arranged in a straight row along the longitudinal direction of the substrate 511 (in the front-to-back direction of the drawing sheet of FIG. 18), and each first light-emitting element 514 emits blue light. The wavelength converter 515 has an elongated shape and seals the first light-emitting elements 514, and converts the wavelength of a portion of the blue light to a wavelength corresponding to a color within the range of green to yellow.

Each second light source 513 includes a plurality of second light-emitting elements 516 and a sealer 517. The second light-emitting elements 516 are arranged in a straight row along the longitudinal direction of the substrate 511, and each second light-emitting element 516 emits red light. The sealer 517 is colorless and transparent, and seals the second light-emitting elements 516.

The first light sources 512 and the second light sources 513 respectively perform the same functions as the first light sources 12 and the second light sources 13 pertaining to the above-described embodiment. There are two first light sources 512 and two second light sources 513, which are arranged in parallel on the substrate 511 at intervals. Each light source has an elongated shape extending along the longitudinal direction of the substrate 511.

According to the present modification, the visible light emitted by the first light sources 512 has a chromaticity within rectangle range ABCD on the CIF 1931 xy chromaticity diagram shown in FIG. 9. The decrease rate ratio is at least 2.0 and no greater than 3.0. The amount of the shift applied to the chromaticity of the visible light emitted by the first light sources 512 is at least 0.01 and no greater than 0.02. Therefore, the chromaticity of the visible light emitted by the first light sources 512 is shifted to be closer to the chromaticity of blue light according to the decrease in optical output level of the red light emitted by the second light sources 513 resulting from the temperature rise. Thus, the stated structure reduces the color deviation of the illumination light caused by the decrease in optical output level of the red light resulting from the temperature rise.

The globe 520 has the same shape as a glass bulb for general incandescent lamps, and houses therein the light-emitting module 510. The globe 520 is made of light-transmissive material such as silica glass or acrylic resin, and is transparent. Hence, the light-emitting module 510, which is housed in the globe 520, is externally visible. Since the light emitting module 510 is disposed substantially at the center of the inside of the globe 520, the lighting device 500 has light distribution properties similar to incandescent lamps. Furthermore, since the substrate 511 is light-transmissive, the light emitted by the first light sources 512 and the second light sources 513 disposed on the upper surface 511*a* of the substrate 511 is allowed to pass through the substrate 511 and travel toward the base 570 as well. Accordingly, the lighting device 500 has light distribution properties even more similar to incandescent lamps. Note that the globe 520 is not necessarily transparent. Alternatively, the globe 520 may be for example a semi-transparent globe whose inner surface is coated with an opaque white diffusion film made of silica. Furthermore, the first light sources 512 and the second light sources 513 may be formed on the lower surface 511*b* of the substrate 511 as well.

The stem 530 has a rod-like shape, and is disposed so as to extend from near the opening 521 of the globe 520 into the globe 520. The base end of the stem 530 is fixed to the supporting member 540. The light-emitting module 510 is attached to the top end of the stem 530. It is preferable that the stem 530 is made of material having a higher thermal conductivity than the material of the substrate 511 of the light-emitting module 510, because the stern 530 needs to conduct heat generated by the light-emitting module 510 to the supporting member 540. For example, metal material such as aluminum or aluminum alloy, or inorganic material such as ceramic, may be used as the material of the stem 530. The light-emitting module 510 is attached to the stem 530 by fixing the substrate 511 of the light-emitting module 510 to the mounting part 531 on the top end of the stem 530 by using fixing material such as adhesive or an adhesive sheet. One example of the adhesive is an adhesive having a high thermal conductivity formed by dispersing fine metal particles in a silicone resin. One example of the adhesive sheet is an adhesive sheet having a high thermal conductivity formed by dispersing a heat conductive filler such as alumina, silica, or titanium oxide in an epoxy resin, and shaping the resin into a sheet and applying an adhesive to both surfaces of the sheet. The high heat conductive adhesive and the high heat conductive adhesive sheet are preferable because they are capable of efficiently conducting heat generated by the light emitting module 510 to the stein 530. Note that the surface of the stem 530 may be processed to be a reflective surface by, for example, mirror finishing through polishing, in order to control the distribution of light.

The supporting member 540 has a disc-like shape, and includes a first supporting part 541 and a second supporting part 542. The first supporting part 541, which is located closer to the light-emitting module 510, is smaller in diameter than the second supporting part 542, which is located closer to the base 570. Due to this difference in diameter, the peripheral portion of the supporting member 540 has a step-like shape. The globe 520 is attached to the supporting member 540 by adhesive 522, with the edge of the opening 521 of the globe 520 being in contact with the step-like portion. Thus, the opening 521 of the globe 521 is closed with the second supporting part 542. As with the stem 530, the supporting member 540 is made of material having a high thermal conductivity such as metal material or inorganic material. Note that the surface of the first supporting part 541 may be processed to be a reflective surface by, for example, minor finishing through polishing, in order to control the distribution of light.

The case 550 is a tubular member that houses therein the circuit unit 560, and is made of insulative material such as polybutylene terephthalate (PBT) that contains glass fibers. The case 550 includes a first case part 551, which is located closer to the globe 520, and a second case part 552, which is located closer to the base 570. The case 550 is fixed to the supporting member 540 by the adhesive 522, with the first case part 551 being fitted onto the supporting member 540. The second case part 552 has a screw groove in an outer circumferential surface thereof, and the base 570 is engaged with the second case part 552 by using the screw groove.

The circuit unit 560 includes a circuit board 561 and a plurality of electronic components 562 mounted on the circuit board 561. The circuit unit 560 is housed within the case 550. The circuit unit 560 is equivalent to the circuit unit 4 pertaining to the above-described embodiment. The light-emitting module 510 and the circuit unit 560 are electrically connected via, for example, feed lines 563 each made of a metal line containing copper (Cu), which has a high thermal conductivity. One end of each feed line 563 is electrically connected to a terminal (omitted from the drawing) of the light-emitting module 510 by soldering or the like, and the other end of each feed line 563 is electrically connected to the circuit unit 560.

The base 570 is of a type defined by Japanese Industrial Standard (JIS), such as of the E-type, and is used as an attachment to a socket (omitted from the drawing) of a common incandescent lamp. The base 570 includes a shell 571, which is also referred to as a cylindrical barrel, and an eyelet 572 having a disc-like shape. The shell 571 and the eyelet 572 are electrically connected to the circuit unit 560 via power feed lines 564 and 565, respectively.

(Modification 6)

Figure 19:
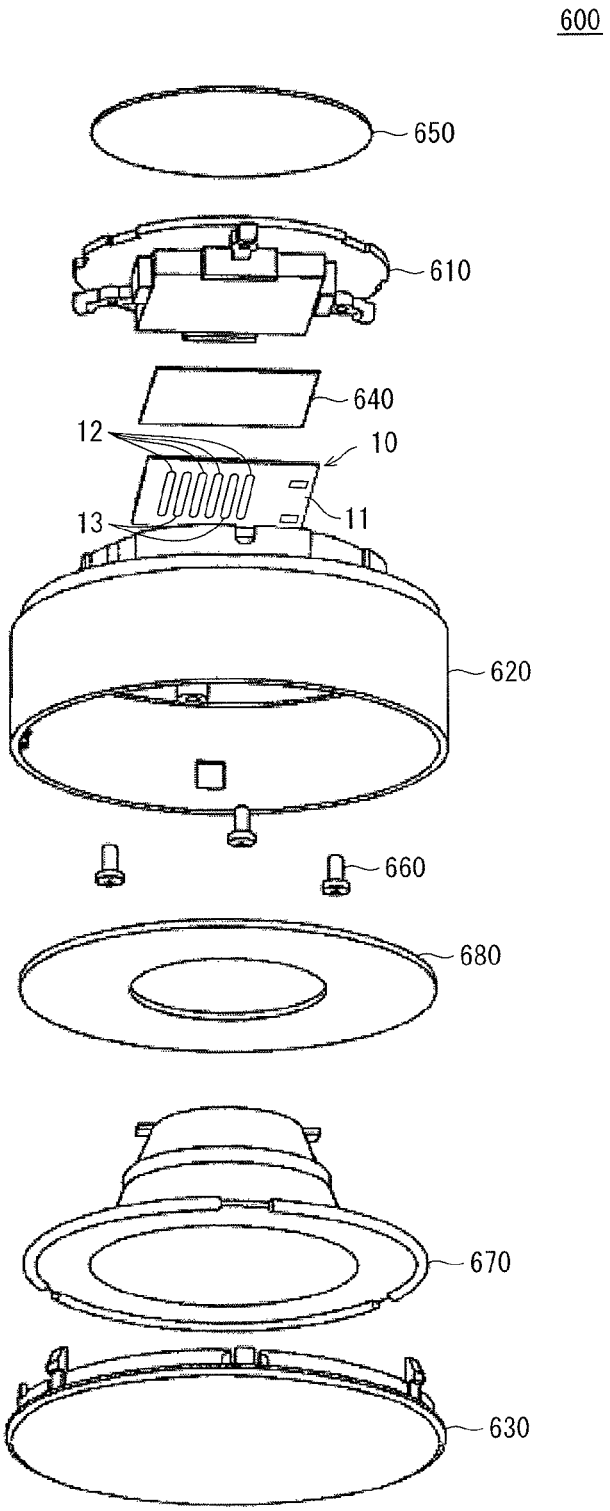
FIG. 19 is an exploded perspective view showing a lighting device pertaining to Modification 6.

FIG. 19 is an exploded perspective view showing a lighting device pertaining to Modification 6. As shown in FIG. 19, the lighting device 600 pertaining to Modification 6 is an LED unit (light engine) having an internal power source circuit, and includes a light-emitting module 10, a mount 610, a case 620, a cover 630, heat conductive sheets 640 and 650, a screw 660 for fixing, a reflection mirror 670 and a circuit unit 680.

The light-emitting module 10 is the same as the light-emitting module 10 pertaining to the above-described embodiment, and includes, as shown in FIG. 4, the substrate 11, the first light sources 12, the second light sources 13, the terminals 18*a* and 18*b*, and the wiring line 19. Each first light source 12 is composed of the first light-emitting elements 14 and the wavelength converter 15, and each second light source 13 is composed of the second light-emitting elements 16 and the sealer 17. Therefore, the chromaticity of the visible light emitted by the first light sources 13 is shifted to be closer to the chromaticity of blue light according to the decrease in optical output level of the red light emitted by the second light sources 13 resulting from the temperature rise. Thus, the stated structure reduces the color deviation of the illumination light caused by the decrease in optical output level of the red light resulting from the temperature rise.

The mount 610 serves as a fixing member for fixing the lighting device 600 to a device mounting surface (omitted from the drawing). The mount 610 serves as a seating to which the substrate 111 of the light-emitting module 10 is to be attached. The mount 610 is made, for example, of material having a high thermal conductivity, such as aluminum.

The case 620 is a cylindrical housing that encloses the light-emitting module 10, and has an opening on the side from which light is to be emitted. The case 620 is made, for example, of insulative synthetic resin such as PBT. The case 620 houses therein the light-emitting module 10, the heat conductive sheet 640, the reflection mirror 670, and the circuit unit 680.

The cover 630 is a member for protecting the light-emitting module 10 and so on housed within the case 620. The cover 630 is attached to the case 620 by adhesive, rivets, screws, or the like so as to close the opening on the side of the case 620 from which light is to be emitted. The cover 630 is made of light-transmissive synthetic resin such as polycarbonate resin, so that light emitted from the light-emitting module 100 efficiently transmits through the cover 630. The inside of the case 620 is visible through the cover 630.

The heat conductive sheet 640 is disposed between the light-emitting module 10 and the mount 610. The heat conductive sheet 640 thermally connects the substrate 11 and the mount 610 with each other. The heat conductive sheet 640 is a silicone rubber sheet or an acrylic sheet for example, and efficiently conducts heat generated by the light-emitting module 610 to the mount 610.

The heat conductive sheet 650 is disposed between the mount 610 and the device mounting surface (omitted from the drawing). Similarly, the heat conductive sheet 650 is a silicone rubber sheet or an acrylic sheet for example. The heat conductive sheet 650 dissipate the heat generated by the light-emitting module 10 and conducted to the heat conductive sheet 650 via the heat conductive sheet 640 and the mount 610, to the device mounting surface.

The mount 610 and the case 620 are fixed to each other by the screw 660 for fixing.

The reflecting mirror 670 is an optical member for efficiently outputting the light from the light-emitting module 10. The reflecting mirror 670 is tubular, and has a diameter that gradually increases toward the cover 630. The reflecting mirror 670 is made of material having a high reflectivity, such as polycarbonate. Note that the inner surface of the reflecting mirror 670 may be coated with a reflective film in order to improve the reflectivity.

The circuit unit 680 includes a circuit board and a plurality of electronic components mounted on the circuit board. The electronic components are omitted from the drawing. The circuit unit 680 has an annular shape with a circular opening, and is disposed around the reflection mirror 670 within the case 620.

[Modification of Lighting Fixture]

The lighting fixture pertaining to one aspect of the present invention is not limited to the lighting fixture 1 pertaining to the above-described embodiment.

For example, although the light-emitting module pertaining to the above-described embodiment is a part of the lighting device built in the lighting-fixture, the light-emitting module can be not a part of the lighting device but an independent component, and may be built directly in the lighting fixture without intervention of the lighting device.

[Modification of Circuit Unit]

In the above-described embodiment, the lighting circuit 4*c*, the dimming ratio detection circuit 4*d* and the control circuit 4*e* are unitized as the circuit unit 4 and thus all of them are provided as external components for the lighting device 6. However, all or some of the components may be built in the lighting device. That is, the lighting circuit, the dimming ratio detection circuit and the control circuit may be all built in the lighting device, or alternatively, only one or two of the three circuits may be built in the lighting device. Furthermore, all or part of the circuit unit may be included in the light-emitting module, and may be installed on the substrate of the light-emitting module. That is, the lighting circuit, the dimming ratio detection circuit and the control circuit may be all built in the light-emitting module, or alternatively, only one or two of the three circuits may be built in the light-emitting module.

[Other Modification]

Although the structure of the present invention has been described based on the above-described embodiment and modifications, the structure of the present invention is not limited to those of the above-described embodiment or the modifications. For example, the present invention may be embodied by combining particular components of the above-described embodiment and modifications according to the need. In addition, note that the materials, the numerical values, and so on described in the embodiment above are nothing more than preferable examples, and accordingly the present invention is not limited by those described in the embodiment above. Furthermore, the structure of the present invention may be modified according to the need, within the scope of the technical idea of the present invention.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

The invention claimed is:

1. A light-emitting module that emits white light generated by mixing red light and visible light of a color other than red, comprising:

a first light source including a first light-emitting element and a wavelength converter and emitting the visible light, the wavelength converter changing a wavelength of a portion of light emitted by the first light-emitting element, the visible light having a chromaticity within rectangle range ABCD defined by coordinate points A(0.15,0.35), B(0.28,0.33), C(0.39,0.48) and D(0.25, 0.55) on a CIE 1931 xy chromaticity diagram;

a second light source including a second light-emitting element and emitting the red light, wherein $2.0 \leq (S_L - S_H)/(F_L - F_H) \leq 3.0$, where $S_L$, $S_H$, $F_L$, and $F_H$ are relative values to a predetermined reference value, and $S_1$ denotes an optical output level of the second light-emitting element measured when the second light-emitting element is at a first temperature, $S_H$ denotes the optical output level of the second light-emitting element measured when the second light-emitting element is at a second temperature that is higher than the first temperature by 30° C., $F_L$ denotes the optical output level of the first light-emitting element measured when the first light-emitting element is at the first temperature, and $F_H$ denotes the optical output level of the first light-emitting element measured when the first light-emitting element is at the second temperature, and $0.01 \leq ((x_L - x_H)^2 + (y_L - y_H)^2)^{1/2} \leq 0.02$, where chromaticity coordinates $(x_L, y_L)$ on the CIE 1931 xy chromaticity diagram identify the chromaticity of the visible light measured when the first light-emitting element is at the first temperature, and chromaticity coordinates $(x_H, y_H)$ on the CIE 1931 xy chromaticity diagram identify the chromaticity of the visible light measured when the first light-emitting element is at the second temperature.

2. The light-emitting module of claim 1, wherein when the wavelength converter is at the second temperature, an emission spectrum of the wavelength converter has a maximum intensity at least 10% and no greater than 20% lower than when the wavelength converter is at the first temperature.

3. The light-emitting module of claim 2, wherein the wavelength converter contains at least a first phosphor and a second phosphor, and when the wavelength converter is at the second temperature, an emission spectrum of the first phosphor has a maximum intensity no greater than 10% lower than when the wavelength converter is at the first temperature, and an emission spectrum of the second phosphor has a maximum intensity at least 20% and no greater than 30% lower than when the wavelength converter is at the first temperature.

4. The light-emitting module of claim 3, wherein the first phosphor is a $Eu^{2+}$-activated oxynitride phosphor, and the second phosphor is a $Eu^{2+}$-activated silicate phosphor.

5. The light-emitting module of claim 1, wherein the first light-emitting element emits blue light having a peak wavelength within a range of 450 nm to 470 nm, and the second light-emitting element emits red light having a peak wavelength within a range of 610 nm to 650 nm.

6. A lighting device that emits white light generated by mixing red light and visible light of a color other than red, comprising:

a first light source including a first light-emitting element and a wavelength converter and emitting the visible light, the wavelength converter changing a wavelength of a portion of light emitted by the first light-emitting element, the visible light having a chromaticity within rectangle range ABCD defined by coordinate points A(0.15,0.35), B(0.28,0.33), C(0.39,0.48) and D(0.25, 0.55) on a CIE 1931 xy chromaticity diagram;

a second light source including a second light-emitting element and emitting the red light, wherein $2.0 \leq (S_L - S_H)/(F_L - F_H) \leq 3.0$, where $S_L$, $S_H$, $F_L$, and $F_H$ are relative values to a predetermined reference value, and $S_L$ denotes an optical output level of the second light-emitting element measured when the second light-emitting element is at a first temperature, $S_H$ denotes the optical output level of the second light-emitting element measured when the second light-emitting element is at a second temperature that is higher than the first temperature by 30° C., $F_L$ denotes the optical output level of the first light-emitting element measured when the first light-emitting element is at the first temperature, and $F_H$ denotes the optical output level of the first light-emitting element measured when the first light-emitting element is at the second temperature, and $0.01 \leq ((x_L - x_H)^2 + (y_L - y_H)^2)^{1/2}) \leq 0.02$, where chromaticity coordinates $(x_L, y_L)$ on the CIE 1931 xy chromaticity diagram identify the chromaticity of the visible light measured when the first light-emitting element is at the first temperature, and chromaticity coordinates $(x_H, y_H)$ on the CIE 1931 xy chromaticity diagram identify the chromaticity of the visible light measured when the first light-emitting element is at the second temperature.

7. A lighting fixture that emits white light generated by mixing red light and visible light of a color other than red, comprising:

a first light source including a first light-emitting element and a wavelength converter and emitting the visible light, the wavelength converter changing a wavelength of a portion of light emitted by the first light-emitting element, the visible light having a chromaticity within rectangle range ABCD defined by coordinate points A(0.15,0.35), B(0.28,0.33), C(0.39,0.48) and D(0.25, 0.55) on a CIE 1931 xy chromaticity diagram;

a second light source including a second light-emitting element and emitting the red light, wherein $2.0 \leq (S_L - S_H)/(F_L - F_H) \leq 3.0$, where $S_L$, $S_H$, $F_L$, and $F_H$ are relative values to a predetermined reference value, and $S_L$ denotes an optical output level of the second light-emitting element measured when the second light-emitting element is at a first temperature, $S_H$ denotes the optical output level of the second light-emitting element measured when the second light-emitting element is at a second temperature that is higher than the first temperature by 30° C., $F_L$ denotes the optical output level of the first light-emitting element measured when the first light-emitting element is at the first temperature, and $F_H$ denotes the optical output level of the first light-emitting element measured when the first light-emitting element is at the second temperature, and $0.01 \leq ((x_L - x_H)^2 + (y_L - y_H)^2)^{1/2} \leq 0.02$, where chromaticity coordinates $(x_L, y_L)$ on the CIE 1931 xy chromaticity diagram identify the chromaticity of the visible light measured when the first light-emitting element is at the first temperature, and chromaticity coordinates $(x_H, y_H)$ on the CIE 1931 xy chromaticity diagram identify the chromaticity of the visible light measured when the first light-emitting element is at the second temperature.

* * * * *